US006007957A

United States Patent [19]

Kobori et al.

[11] Patent Number: 6,007,957

[45] Date of Patent: Dec. 28, 1999

[54] MAGNETIC TONER, IMAGE FORMING METHOD AND PROCESS CARTRIDGE

[75] Inventors: Takakuni Kobori, Susono; Tsutomu Onuma; Nobuyuki Okubo, both of Yokohama; Masaichiro Katada, Souka; Masao Takano, Susono, all of Japan

[73] Assignee: Canon Kabushiki Kaisha, Tokyo, Japan

[21] Appl. No.: 09/159,573

[22] Filed: Sep. 24, 1998

[30] Foreign Application Priority Data

Sep. 25, 1997 [JP] Japan ..... 9-259993
Mar. 6, 1998 [JP] Japan ..... 10-054930

[51] Int. Cl.[6] ..... G03G 9/083; G03G 13/08; G03G 15/08

[52] U.S. Cl. ..... 430/106.6; 430/111; 430/120; 399/262

[58] Field of Search ..... 430/106.6, 111, 430/120

[56] References Cited

U.S. PATENT DOCUMENTS 5,406,353 4/1995 Asanae ..... 399/174
5,411,830 5/1995 Matsunaga ..... 430/111
5,424,810 6/1995 Tomiyama et al. ..... 430/106.6
5,652,060 7/1997 Uchida et al. ..... 428/404
5,663,026 9/1997 Kasuya et al. ..... 430/106.6
5,707,770 1/1998 Tanikawa et al. ..... 430/110
5,750,302 5/1998 Ogawa et al. ..... 430/111
5,824,442 10/1998 Tanikawa et al. ..... 430/120
5,843,610 12/1998 Uchida et al. ..... 430/106.6

OTHER PUBLICATIONS

Patent Abstracts of Japan, vol. 95, No. 8, 9/95 of JP 7–128901.

Data Base, Section Ch., Week 9229, Derwent Publ.; XP 002097605, for JP 4–162050.

*Primary Examiner*—Roland Martin
*Attorney, Agent, or Firm*—Fitzpatrick, Cella, Harper & Scinto

[57] ABSTRACT

A magnetic toner includes magnetic toner particles containing at least a binder resin and a magnetic iron oxide. The magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element on the basis of an iron element; the ratio $(B_{si}/A_{Si})\times100$ of the content $B_{Si}$ of the silicon element present in the magnetic iron oxide up to an iron element solubility of 20% by weight to the total content $A_{Si}$ of the silicon element present in the magnetic iron oxide is 45 to 85%; the ratio $(C_{si}/A_{Si})\times100$ of the content $C_{Si}$ of the silicon element present in the magnetic iron oxide up to an iron element solubility of 10% by weight to the total content $A_{Si}$ is 35 to 70%; and the magnetic toner has a weight average particle diameter of 3.5 to 10.0 $\mu$m, and contains 0 to 30% by volume of magnetic toner particles having a volume particle diameter of 12.7 $\mu$m or more determined from a volume distribution.

101 Claims, 4 Drawing Sheets

MAGNETIC TONER, IMAGE FORMING METHOD AND PROCESS CARTRIDGE

BACKGROUND OF THE INVENTION

1. Field of the Invention

The present invention relates to a magnetic toner used for image forming methods such as an electrophotographic method, an electrostatic printing method, a magnetic recording method, and a toner jet method. Particularly, the present invention relates to a magnetic toner for developing electrostatic latent images, and an image forming method and a process cartridge, both of which use the magnetic toner.

2. Description of the Related Art

Many electrophotographic methods have been conventionally known, as disclosed in U.S. Pat. No. 2,297,691, Japanese Patent Publication No. 42-23910 (corresponding to U.S. Pat. No. 3,666,363) and Japanese Patent Publication No. 43-24748 (corresponding to U.S. Pat. No. 4,071,361). In these methods, generally, an electric latent image is formed on a photosensitive member by any one of various means using a photoconductive material, and then the latent image is developed by using toner to form a toner image as a visible image, and if required, the toner image is transferred to a transfer material such as paper or the like, followed by fixing under heating, pressure or heating and pressure to obtain a copy or print.

There are also various known developing methods of visualizing electrostatic latent images by using toner. Examples of such developing methods include the magnetic brush method disclosed in U.S. Pat. No. 2,874,063, the cascade developing method disclosed in U.S. Pat. No. 2,618,552, and the powder cloud method disclosed in U.S. Pat. No. 2,221,776, a fur brush developing method, a liquid developing method, etc. Of these developing methods, particularly, the magnetic brush method, the cascade method and the liquid developing method, all of which use a two-component type developer mainly comprising a toner and a carrier, are brought into practical use. Although all these methods are excellent methods capable of relatively stably obtaining good images, they have a problem with respect to the two-component type developer in which the carrier deteriorates, and the mixing ratio of the toner and the carrier varies.

In order to solve the problems, various developing methods are proposed, which use a one-component type developer comprising only a toner. Particularly, methods using a one-component type developer comprising toner particles having magnetism are excellent.

U.S. Pat. No. 3,909,258 proposes a developing method using a magnetic toner having electric conductivity for development. In this method, a conductive magnetic toner is supported on a cylindrical conductive sleeve having magnetism therein, and is brought into contact with an electrostatic latent image holding member having an electrostatic latent image to develop the latent image. At this time, in the development unit, a conductive path is formed by toner particles between the surface of the electrostatic latent image holding member and the sleeve surface. Charge is led to the toner particles from the sleeve through the conductive path, and the toner particles are adhered to the image region due to Coulomb's force between the image region of the electrostatic latent image and the magnetic toner particles to develop the latent image. Although this method using a conductive magnetic toner is an excellent method capable of solving the problems of the conventional two-component developing methods, the method has a problem in which since the toner is conductive, it is difficult to electrostatically transfer a toner image from the electrostatic latent image holding member having the toner image to a final support member such as plain paper or the like.

As a developing method using a high-resistance magnetic toner which can be electrostatically transferred, there is a developing method which employs dielectric polarization of toner particles. However, this method has a problem in which the development speed is fundamentally low, and thus a developed image having a sufficient density cannot be obtained.

Another known development method using a high-resistance insulating magnetic toner is a method in which magnetic toner particles are triboelectrically charged by friction between the respective magnetic toner particles and friction between the magnetic toner particles and a triboelectric charging member such as a sleeve or the like to develop an electrostatic latent image by the magnetic toner having triboelectric charge. However, such a method has problems in which the number of times of friction between the magnetic toner particles and the triboelectric charging member is small, causing insufficient triboelectric charge, and in which the charged magnetic toner particles easily agglomerate on the sleeve due to an increase in Coulomb's force between the toner particles and the sleeve.

Japanese Patent Laid-Open No. 55-18656 discloses a new jumping development method capable of solving the above problems. In this method, a magnetic toner is thinly coated on a sleeve, and frictionally charged, and then the magnetic toner layer on the sleeve is brought near an electrostatic latent image to develop the latent image. In this method, the magnetic toner is thinly coated on the sleeve to increase the opportunity of contact between the sleeve and the magnetic toner, thereby permitting sufficient triboelectric charge. Also the magnetic toner is supported by magnetic force, and a magnet and the magnetic toner are relatively moved to prevent agglomeration of the magnetic toner particles and cause sufficient friction with the sleeve, thereby obtaining an excellent image.

The insulating toner used in the above development method comprises a sufficient amount of finely powdered magnetic material mixed and dispersed therein, and partially exposed from the surfaces of the toner particles. Therefore, the type of the magnetic material used influences the fluidity and triboelectric chargeability of the magnetic toner, thereby influencing various characteristics required for the magnetic toner, such as the development performance and durability of the magnetic toner, etc.

In further detail, in the conventional jumping development method using a magnetic toner containing a magnetic material, repetition of a development step (for example, copying) for a long period of time causes deterioration in the fluidity of a one-component type developer containing the magnetic toner, insufficient triboelectric charge, nonuniformity in charging, and fogging in an environment of low temperature and low humidity, thereby causing a problem of image quality. With low adhesion between the binder resin and the magnetic material which constitute the magnetic toner particles, repetition of the development step causes separation of the magnetic material from the surfaces of the magnetic toner particles. There is thus the tendency to cause an adverse effect on the toner image, such as a decrease in density of the toner image.

With the magnetic toner containing the magnetic material dispersed therein with nonuniformity, the small particles of the magnetic toner containing a large amount of magnetic material are accumulated on the sleeve, thereby sometimes causing a decrease in image density and the occurrence of nonuniformity in density, which is referred to as "sleeve ghost".

With respect to the magnetic iron oxide contained in conventional magnetic toner, magnetic toner containing magnetic iron oxide particles containing a silicon element is proposed in Japanese Patent Laid-Open Nos. 62-279352 (corresponding to U.S. Pat. No. 4820603), and 62-278131 (corresponding to U.S. Pat. No. 4975214). Although a silicon element is positively contained in such magnetic iron oxide particles, the magnetic toner containing the magnetic ion oxide particles has the need to improve the fluidity of the magnetic toner.

In Japanese Patent Laid-Open No. 3-9045 (corresponding to European Patent Application Publication EP-A187434), it is proposed that the shape of magnetic iron oxide particles is controlled to a spherical shape by adding silicate. In the magnetic iron oxide particles obtained by this method, large amounts of silicon element are distributed in the magnetic ion oxide particles because of the use of silicate for controlling the particle size, but the silicon element is less present on the surfaces of the magnetic iron oxide particles, thereby causing insufficient improvement in the fluidity of the magnetic toner.

A method is proposed in Japanese Patent Laid-Open No. 61-34070, in which triiron tetraoxide is produced by adding a hydroxosilicate solution in oxidization to triiron tetraoxide. The triiron tetraoxide particles obtained by this method contain Si element in the vicinity of the surfaces thereof, but have a problem in which the surfaces have low resistance to mechanical shock such as fraction or the like because the Si element is present in a layer near the surfaces of the triiron tetraoxide particles.

In Japanese Patent Laid-Open No. 5-72801, a magnetic toner is proposed, which contains magnetic iron oxide particles containing 0.4 to 4% by weight of silicon element, 44 to 84% of the total content of the silicon element being present in the vicinity of the surfaces of the magnetic particles.

In the magnetic toner containing the magnetic iron oxide particles, the fluidity of the toner, and the adhesion between the binder resin and the magnetic iron oxide particles are improved. However, in the magnetic iron oxide particles disclosed in a production example, a large amount of silicate component is present in the uppermost surfaces, and a porous structure is formed in the surfaces of the magnetic iron oxide particles, thereby increasing the BET specific surface area of the magnetic iron oxide particles. Therefore, the magnetic toner containing the magnetic iron oxide particles have the tendency that triboelectric charge properties deteriorate after allowing to stand in an environment of high humidity for a long time.

Japanese Patent Laid-Open No. 4-362954 (corresponding to European Patent Application Publication No. EP-A468525) discloses magnetic iron oxide particles containing silicon and aluminum elements. However, there is demand for further improving environmental properties.

Japanese Patent Laid-Open No. 5-213620 discloses magnetic iron oxide particles containing a silicon component which is exposed from the surfaces thereof. However, like the above magnetic iron oxide particles, there is demand for further improving environmental properties.

Japanese Patent Laid-Open No. 7-239571 discloses that magnetic iron oxide particles contain silicon element, and the Fe—Si ratio of the uppermost surface is controlled. Although this improves frictional chargeability in an environment of high humidity, the magnetic iron oxide particles described in a production example have the tendency that the bulk density is increased, and a toner containing the magnetic iron oxide particles is liable to be densely packed in a development unit.

In a high-capacity system in which the toner fill in the development unit is increased for complying with recent increases in processing speed and lifetime, such a magnetic toner is easily packed in the development unit due to the weight of the toner and the pressure by a agitator, thereby causing insufficient supply of the toner to the sleeve and a fading phenomenon in which an image is blanked in a strip.

Such a magnetic toner is also insufficient in improvement of fluidity. Particularly, when a cartridge is transported for a long time, the toner contained in the cartridge is deviated to one side and tapped therein. Therefore, in this state, image formation easily causes nonuniformity in distribution of the toner on the sleeve, and sometimes causes blanking in an image.

Japanese Patent Laid-Open Nos. 9-59024 and 9-59025 disclose magnetite particles containing 1.7 to 4.5 atomic % of silicon in terms of Si based on Fe, and, as a metal element other than Fe, 0 to 10 atomic % of at least one metal element selected from Mn, Zn, Ni, Cu, Al, and Ti based on Fe.

Although this can improve magnetic properties and chargeability, the fluidity of the toner cannot be sufficiently improved only by adding the above metals, and the toner has a property to be further improved.

Furthermore, in order to improve the fluidity of a toner, besides the magnetic material, other raw materials of the toner are demanded to be controlled for improving the fluidity.

Japanese Patent Laid-Open Nos. 62-226260, 63-139365, 3-50559 and 6-208244 disclose a toner or toner resin composition containing polypropylene modified by carboxylic acid or maleic acid. However, the fluidity of the toner cannot be sufficiently improved.

In recent years, there have been demand for increasing the operation speed and lifetime of an image forming apparatus using an electrophotographic technology, such as a copying machine and a laser beam printer, and demand for improving definition and quality of the toner image obtained. A toner and a process cartridge containing a toner are stored in a variety of environments, and thus storage stability is an important property of the toner.

In recent, as printer apparatus, light-emitting diode (LED) printer and laser beam printer have been mainly put on the market. In a technical tendency, resolution have been increased, i.e., conventional resolution of 240 or 300 dpi has been increased to 400, 600, or 1200 dpi. Accordingly, a development system has been required to have higher definition.

A copying machine is increasingly made highly functional, and is thus increasingly digitized. In this tendency, an electrostatic image is mainly formed by a laser, and thus resolution is also increased. In this case, like a printer, a development system having high resolution and high definition is required. Japanese Patent Laid-Open Nos. 1-112253 and 2-284158 disclose a toner having a small particle size.

However, a high-resolution and high-definition image can be formed by decreasing the particle size of a toner, while the surface area per unit weight of the magnetic toner is increased to increase the tribo charge of the magnetic toner.

Therefore, the fluidity of the magnetic toner deteriorates, thereby making further significant the fading phenomenon and nonuniformity in the magnetic toner on the sleeve.

SUMMARY OF THE INVENTION

An object of the present invention is to provide a magnetic toner in which the above problems are solved, and an image forming method and a process cartridge both of which use the magnetic toner.

Another object of the present invention is to provide a magnetic toner which can form an image with high density and excellent reproducibility, and an image forming method and a process cartridge both of which use the magnetic toner.

Still another object of the present invention is to provide a magnetic toner causing no fogging in long-term use and having stable chargeability, and an image forming method and a process cartridge both of which use the magnetic toner.

A further object of the present invention is to provide a magnetic toner exhibiting excellent chargeability and long-term storage properties even in an environment of high humidity, and an image forming method and a process cartridge both of which use the magnetic toner.

A still further object of the present invention is to provide a magnetic toner causing no fading phenomenon even in application to an image forming method using a high-capacity development unit, and an image forming method and a process cartridge both of which use the magnetic toner.

A further object of the present invention is to provide a magnetic toner which can form an image with high resolution and high definition and which causes no fading phenomenon even in application to an image forming method using a high-capacity development unit, and an image forming method and a process cartridge both of which use the magnetic toner.

A further object of the present invention is to provide a magnetic toner which can be supplied onto a sleeve even when the toner is tapped on one side in a cartridge, and thus causes no blanking in an image, and an image forming method and a process cartridge both of which use the magnetic toner.

A object of the present invention is to provide a magnetic toner comprising:

magnetic toner particles containing at least a binder resin and a magnetic iron oxide;

wherein the magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element based on the iron element; the ratio $(B_{si}/A_{Si})\times100$ of the content $B_{Si}$ of the silicon element present in the magnetic iron oxide up to an iron element solubility of 20% by weight to the total content $A_{Si}$ of the silicon element present in the magnetic iron oxide is 45 to 85%; the ratio $(C_{si}/A_{Si})\times100$ of the content $C_{Si}$ of the silicon element present in the magnetic iron oxide up to an iron element solubility of 10% by weight to the total content $A_{Si}$ is 35 to 70%; and the magnetic toner has a weight average particle diameter of 3.5 to 10.0 μm, and contains 0 to 30% by volume of magnetic toner particles having a volume particle diameter of 12.7 μm or more determined from a volume distribution.

A object of the present invention is to provide an image forming method comprising the steps of:

charging an electrostatic latent image holding member for holding an electrostatic latent image, forming an electrostatic latent image on the charged electrostatic latent image holding member, and developing the electrostatic latent image on the electrostatic latent image holding member by using a magnetic toner to form a toner image;

wherein the magnetic toner comprises magnetic toner particles containing at least a binder resin and a magnetic iron oxide;

the magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element on the basis of the iron element; the ratio $(B_{si}/A_{Si})\times100$ of the content $B_{Si}$ of silicon element present in the magnetic iron oxide up to an iron element solubility of 20% by weight to the total content $A_{Si}$ of the silicon element present in the magnetic iron oxide is 45 to 85%; the ratio $(C_{si}/A_{Si})\times100$ of the content $C_{Si}$ of the silicon element present in the magnetic iron oxide up to an iron element solubility of 10% by weight to the total content $A_{Si}$ is 35 to 70%; and the magnetic toner has a weight average particle diameter of 3.5 to 10.0 μm, and contains 0 to 30% by volume of magnetic toner particles having a volume particle diameter of 12.7 μm or more determined from a volume distribution.

A object of the present invention is to provide a process cartridge detachably mountable on a main assembly of an image forming apparatus comprising:

an electrostatic latent image holding member for holding an electrostatic latent image, and developing means having a magnetic toner for developing the electrostatic latent image;

wherein the magnetic toner comprises magnetic toner particles containing at least a binder resin and a magnetic iron oxide;

the magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element on the basis of the iron element; the ratio $(B_{si}/A_{Si})\times100$ of the content $B_{Si}$ of the silicon element present in the magnetic iron oxide up to an iron element solubility of 20% by weight to the total content $A_{Si}$ of silicon element present in the magnetic iron oxide is 45 to 85%; the ratio $(C_{si}/A_{Si})\times100$ of the content $C_{Si}$ of the silicon element present in the magnetic iron oxide up to an iron element solubility of 10% by weight to the total content $A_{Si}$ is 35 to 70%; and the magnetic toner has a weight average particle diameter of 3.5 to 10.0 μm, and contains 0 to 30% by volume of magnetic toner particles having a volume particle diameter of 12.7 μm or more determined from a volume distribution.

Further objects, features and advantages of the present invention will become apparent from the following description of the preferred embodiments with reference to the attached drawings.

DESCRIPTION OF THE PREFERRED EMBODIMENT

Figure 1:
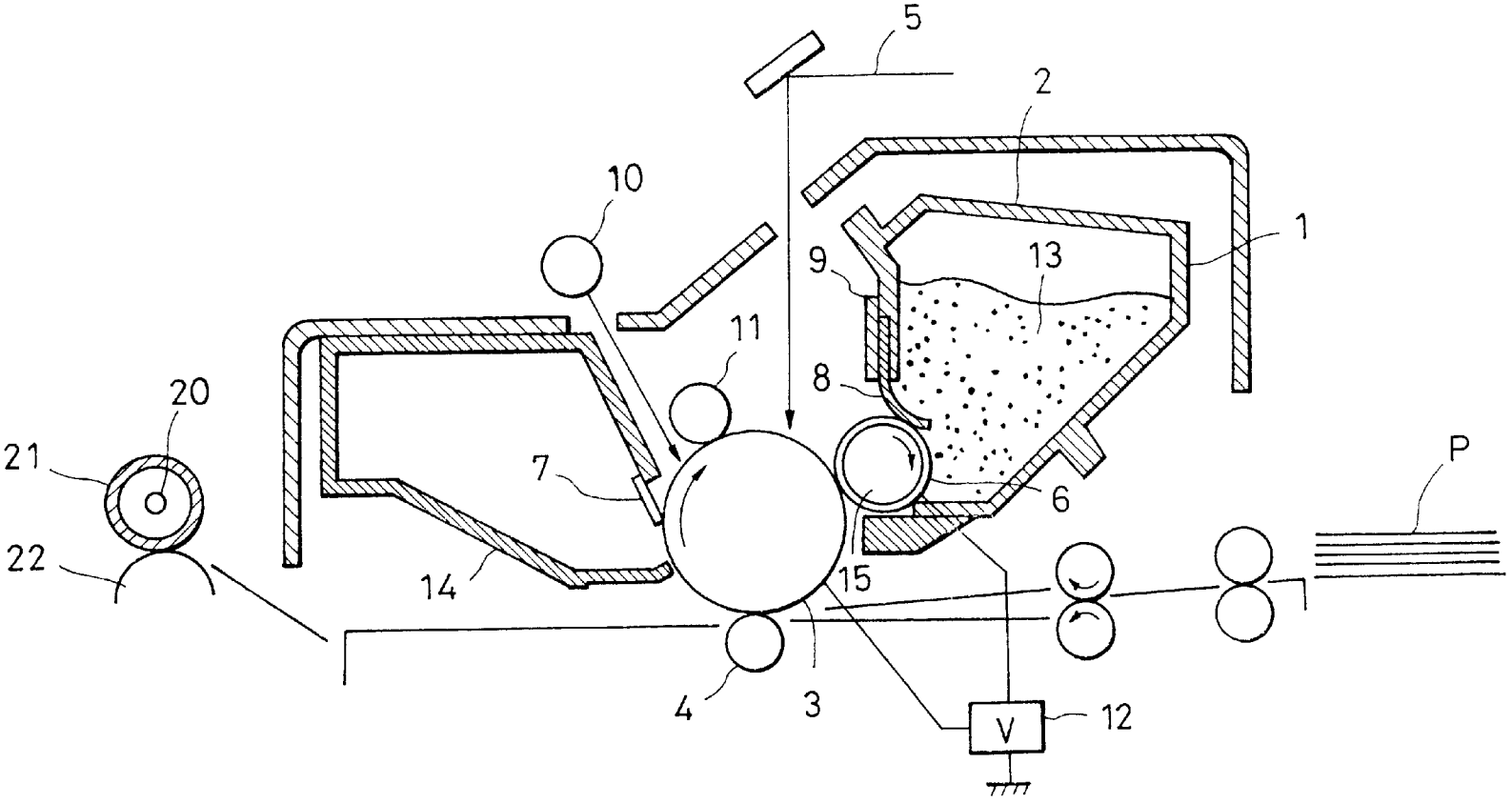
FIG. 1 is a schematic drawing illustrating an image forming apparatus capable of carrying out an image forming method of the present invention.

As a result of intensive research for solving the above problems, the inventors found that the fluidity, long-term storage stability, durability and dispersibility of a magnetic material in toner particles of a toner having a small particle diameter can be improved by controlling the composition and structure of the magnetic iron oxide particles contained in the magnetic toner.

Namely, the present invention is characterized in that the magnetic iron oxide contained in the magnetic toner contains 0.2 to 0.8% by weight of silicon element, and as a metal element other than iron, 0.2 to 4.0% by weight of at least one metal element (another metal element) selected from the group consisting of Mn, Zn, Ni, Cu, Co, Cr, Cd, Al, Sn and Mg, on the basis of the iron element. Combination of another metal element and silicon element suppresses precipitation of a silicon compound in vicinity of the surfaces of the magnetic iron oxide to some extent, and the suppression of precipitation is compensated for by another metal element. It is thus possible to keep down the hygroscopicity of the magnetic toner without deterioration in the effect of improving fluidity of the magnetic iron oxide.

In the present invention, the magnetic iron oxide preferably contains 0.2 to 0.8% by weight of silicon element, more preferably 0.3 to 0.7% by weight, based on the iron element.

With the silicon element at a content of less than 0.2% by weight, the effect of improving the magnetic toner, particularly the effect of improving the fluidity of the magnetic toner, is insufficient. With the silicon element at a content of over 0.8% by weight, chargeability deteriorates in long-terms storage and long-term duration in an environment of high humidity, and the durability of the magnetic toner and the dispersibility of the magnetic iron oxide in the toner binder resin also deteriorate.

With another metal element at a content of less than 0.2% by weight, the effect of improving the fluidity of the magnetic toner is insufficient. With another metal element at a content of over 4.0% by weight, the magnetic iron oxide adversely affects the chargeability of the magnetic toner.

In the present invention, the ratio $(B_{si}/A_{Si})\times 100$ of the content $B_{Si}$ of the silicon element present in the magnetic iron oxide up to an iron element solubility of 20% by weight to the total content $A_{Si}$ of the silicon element present in the magnetic iron oxide is 45 to 85%, preferably 50 to 80%. The ratio $(C_{si}/A_{Si})\times 100$ of the content $C_{Si}$ of the silicon element present in the magnetic iron oxide up to an iron element solubility of 10% by weight to the total content $A_{Si}$ is 35 to 70%, preferably 40 to 65%.

With a ratio $(B_{si}/A_{Si})\times 100$ of less than 45%, or a ratio $(C_{si}/A_{Si})\times 100$ of less than 35%, a large amount of silicon is present the magnetic material, thereby adversely affecting the production process and producing magnetic iron oxide having unstable magnetic properties. With a ratio $(B_{si}/A_{Si})\times 100$ of over 85%, or a ratio $(C_{si}/A_{Si})\times 100$ of over 70%, a large amount of silicon element is present in the surface layer of the magnetic iron oxide, thereby lowering the resistance to mechanical shock and easily causing trouble in use for a magnetic toner.

In the present invention, the ratio $(B_{metal}/A_{metal})\times 100$ of the content $B_{metal}$ of at least one metal element selected from the group consisting of Mn, Zn, Ni, Cu, Co, Cr, Cd, Al, Sn and Mg and present in the magnetic iron oxide up to an iron element solubility of 20% by weight to the total content $A_{metal}$ of metal element present in the magnetic iron oxide is preferably 40 to 100%. With a ratio $(B_{metal}/A_{metal})\times 100$ of less than 40%, another metal hardly effectively acts in the vicinity of the surfaces of the magnetic iron oxide, thereby adversely affecting the production process, and sometimes producing magnetic iron oxide having unstable magnetic properties.

In the present invention, with the magnetic iron oxide containing Mn element as another metal element, the content of the Mn element in the magnetic iron oxide is preferably 0.7 to 2.0% by weight, more preferably 0.8 to 1.8% by weight, based on the iron element.

At a Mn element content of less than 0.7% by weight, the effect of improving the magnetic toner, particularly the effect of improving the fluidity of the magnetic toner, is insufficient. At a Mn element content of over 2.0% by weight, chargeability deteriorates in long-term storage and long-term duration in an environment of high humidity, and the durability of the toner and the dispersibility of the magnetic iron oxide in the binder resin also deteriorate.

In the present invention, the ratio $(B_{Mn}/A_{Mn})\times 100$ of the content $B_{Mn}$ of Mn element present in the magnetic iron oxide up to an iron element solubility of 20% by weight to the total content $A_{Mn}$ of Mn element present in the magnetic iron oxide is preferably 50 to 90%, more preferably 60 to 85%.

With a ratio $(B_{Mn}/A_{Mn})\times 100$ of less than 50%, a large amount of Mn element is present in the magnetic material, thereby adversely affecting the production process, and sometimes producing magnetic iron oxide having stable magnetic properties. With a ratio $(B_{Mn}/A_{Mn})\times 100$ of over 90%, a large amount of Mn element is present in the surface layer of the magnetic iron oxide, thereby lowering the resistance to mechanical shock and easily adversely affecting chargeability.

In the present invention, with the magnetic iron oxide containing Zn element as another metal element, the content of the Zn element in the magnetic iron oxide is preferably 0.2 to 0.8% by weight, more preferably 0.3 to 0.7% by weight, based on the iron element.

At a Zn element content of less than 0.2% by weight, the effect of improving the fluidity of the magnetic toner, is insufficient. At a Zn element content of over 0.8% by weight, chargeability deteriorates in long-term storage and long-term duration in an environment of high humidity, and the durability of the toner and the dispersibility of the magnetic iron oxide in the binder resin also deteriorate.

In the present invention, the ratio $(B_{Zn}/A_{Zn})\times 100$ of the content $B_{Zn}$ of Zn element present in the magnetic iron oxide up to an iron element solubility of 20% by weight to the total content $A_{Zn}$ of Zn element present in the magnetic iron oxide is preferably 50 to 90%, more preferably 55 to 90%.

With a ratio $(B_{Zn}/A_{Zn})\times 100$ of less than 50%, a large amount of Zn element is present in the magnetic material, thereby adversely affecting the production process, and sometimes producing magnetic iron oxide having stable magnetic properties. With a ratio $(B_{Zn}/A_{Zn})\times 100$ of over 90%, a large amount of Zn element is present in the surface layer of the magnetic iron oxide, thereby lowering the resistance to mechanical shock and easily causing trouble in use for a magnetic toner.

In the present invention, with the magnetic iron oxide containing Cu element as another metal element, the content of the Cu element in the magnetic iron oxide is preferably 0.01 to 0.8% by weight, more preferably 0.05 to 0.7% by weight, based on the iron element.

At a Cu element content of less than 0.01% by weight, the effect of improving a magnetic toner, particularly the effect of improving the fluidity of the magnetic toner, is insufficient. At a Cu element content of over 0.8% by weight, chargeability deteriorates in long-term storage and long-term duration in an environment of high humidity, and the durability of the toner and the dispersibility of the magnetic iron oxide in the binder resin also deteriorate.

In the present invention, the ratio $(B_{Cu}/A_{Cu})\times100$ of the content $B_{Cu}$ of Cu element present in the magnetic iron oxide up to an iron element solubility of 10% by weight to the total content $A_{Cu}$ of Cu element present in the magnetic iron oxide is preferably 70 to 100%, more preferably 80 to 100%.

With a ratio $(B_{Cu}/A_{Cu})\times100$ of less than 70%, a large amount of Cu element is present in the magnetic material, thereby adversely affecting the production process, and sometimes producing magnetic iron oxide having unstable magnetic properties.

In the present invention, with the magnetic iron oxide containing Ni element as another metal element, the content of the Ni element in the magnetic iron oxide is preferably 0.1 to 0.6% by weight, more preferably 0.2 to 0.6% by weight, based on the iron element.

At a Ni element content of less than 0.1% by weight, the effect of improving a magnetic toner, particularly the effect of improving the fluidity of the magnetic toner, is insufficient. At a Ni element content of over 0.6% by weight, chargeability deteriorates in long-term storage and long-term duration in an environment of high humidity, and the durability of the toner and the dispersibility of the magnetic iron oxide in the binder resin also deteriorate.

In the present invention, the ratio $(B_{Ni}/A_{Ni})\times100$ of the content $B_{Ni}$ of Ni element present in the magnetic iron oxide up to an iron element solubility of 20% by weight to the total content $A_{Ni}$ of Ni element present in the magnetic iron oxide is preferably 40 to 100%, more preferably 50 to 100%.

With a ratio $(B_{Ni}/A_{Ni})\times100$ of less than 40%, a large amount of Ni element is present in the magnetic material, thereby adversely affecting the production process, and sometimes producing magnetic iron oxide having unstable magnetic properties.

The magnetic iron oxide preferably has a spheroidicity of 0.80 to 1.00, more preferably 0.82 to 1.00, based on the measurement method which will be described below.

With a spheroidicity of less than 0.80, the magnetic iron oxide particles are brought into surface contact with each other, and thus magnetic iron oxide particles having a small particle diameter of 0.1 to 1.0 $\mu$m cannot be easily separated from each other even by mechanical shearing force. Therefore, in some cases, the magnetic iron oxide cannot be sufficiently dispersed in the magnetic toner.

The magnetic iron oxide particles preferably have a bulk density of 0.4 to 0.8 g/m$^3$, more preferably 0.5 to 0.7 g/m$^3$, based on the measurement method which will be described below.

With a bulk density of less than 0.4 g/m$^3$, physical mixing properties with other constituent materials of the toner are adversely affected in production of the toner, thereby deteriorating the dispersibility of the magnetic iron oxide in the toner. With a bulk density of over 0.8 g/m$^3$, the magnetic toner containing the magnetic iron oxide is easily packed in the development unit, thereby deteriorating the fluidity of the toner and causing fading in some cases.

From the viewpoint of uniformity in dispersibility of the magnetic toner in the binder resin and uniformity in chargeability thereof, the magnetic iron oxide of the present invention preferably has a number average particle diameter of 0.05 to 1.00 $\mu$m, more preferably 0.10 to 0.40 $\mu$m, based on the measurement method which will be described below.

With the magnetic ion oxide having a number average particle diameter of over 1.00 $\mu$m, the number of the magnetic iron oxide particles contained in the toner is decreased, thereby easily causing nonuniformity in dispersion of the magnetic iron oxide in the binder resin, and thus deteriorating uniformity of chargeability. With the magnetic ion oxide having a number average particle diameter of less than 0.05 $\mu$m, adhesion between the magnetic iron oxide particles is increased, thereby deteriorating dispersibility in the binder resin.

The magnetic toner of the present invention preferably has a weight average particle diameter of 3.5 to 10.0 $\mu$m, more preferably 4.5 to 9.0 $\mu$m. From the viewpoint of improvements in resolution and definition of an image, the content of the magnetic toner particles having a particle diameter of 12.7 $\mu$m or more, which is determined from a volume distribution, is 0 to 30% volume, preferably 0 to 20% by volume.

With the magnetic toner having a weight average particle diameter of over 10.0 $\mu$m, reproducibility of fine lines of a graphic image and sharpness of the contour of a character deteriorate, while with the magnetic toner having a weight average particle diameter of less than 3.5 $\mu$m, image density significantly deteriorates.

With the magnetic toner containing over 30% by volume of toner particles having a particle diameter of 12.7 $\mu$m or more, the diameter thereof is significantly different from the diameter of the fine toner contained, thereby causing non-ouniformity in chargeability and easily causing fogging.

From the viewpoint of improvements in resolution and definition, the magnetic toner of the present invention preferably has a volume average particle diameter of 2.5 to 6.0 $\mu$m.

With the magnetic toner having a volume average particle diameter of over 6.0 $\mu$m, reproducibility of the fine lines of a graphic image deteriorates. With the magnetic toner having a volume average particle diameter of less than 2.5 $\mu$m, image density easily deteriorates.

In the magnetic toner of the present invention, from the viewpoint of uniformity of an image, the content of the magnetic toner particles having a diameter of less than 4.0 $\mu$m (a particle diameter of 2.0 m to 4.0 $\mu$m), which is determined from a number distribution, is 10 to 40% by number. With the magnetic toner containing over 40% by number of toner particles having a particle diameter of less than 4.0 $\mu$m, fogging easily occurs due to nonuniform charging, while with the magnetic toner containing less than 10% by number of toner particles having a particle diameter of less than 4.0 $\mu$m, reproducibility of a faithful image deteriorates.

The magnetic toner of the present invention preferably contains 20 to 200 parts by weight of magnetic iron oxide particles, more preferably 30 to 150 parts by weight, based on 100 parts by weight of binder resin.

With the magnetic iron oxide at a content of less than 20 parts by weight, transportability is insufficient, thereby causing the tendency that nonuniformity occurs in the developer layer on the developer supporting member, and causes nonuniformity in an image. With the magnetic iron oxide at a content of over 200 parts by weight, image density significantly deteriorates.

The magnetic iron oxide particles of the present invention may be treated with a surface treatment agent such as a silane coupling agent, a titanium coupling agent, titanate, aminosilane or an organosilicic compound, or the like.

Examples of the binder resin contained in the magnetic toner of the present invention include homopolymers of styrene or substituted styrene, such as polystyrene, polyvinyltoluene, and the like; styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, styrene-maleate copolymers, and the like; polymethyl methacrylate; polybutyl methacrylate; polyvinyl acetate; polyethylene; polypropylene; polyvinyl butyral; silicone resins; polyester resins; polyamide resins; epoxy resins; polyacrylic acid resins; rosin; modified rosin; tenper resins; phenolic resins; aliphatic or alicyclic hydrocarbon resins; aromatic petroleum resins; paraffin wax; and carnauba wax. These resins can be used singly or in a mixture. Particularly, styrene copolymers and polyester resins are preferred from the viewpoints of development properties and fixing properties.

From the viewpoint of high compatibility between the fixing properties and anti-offset properties in fixing of the magnetic toner, the magnetic toner of the present invention preferably contains as a fixing auxiliary hydrocarbon wax and ethylenic olefin polymer (homopolymer or copolymer) together with the binder resin.

Examples of polymers used as ethylenic olefin homopolymers or ethylenic olefin copolymers include polyethylene, polypropylene, ethylene-propylene copolymers, ethylene-vinyl acetate copolymers, ethylene-ethyl acrylate copolymers, ionomers having a polyethylene skeleton, and the like. These copolymers preferably contain 50 molt or more (more preferably 60 molt or more) of olefin monomer.

In the present invention, particularly, polypropylene wax having an acid value of 1 to 30 mg KOH/g is preferably used.

As a result of intensive research, the inventors found that in a magnetic toner containing the above-described specified magnetic iron oxide, coating stability of a fine particle toner on a sleeve, development performance, durability, dispersibility of the magnetic material in the toner, fixing performance, and anti-offset properties can be significantly improved by controlling the acid value and thermal properties of the wax contained in the magnetic toner.

Namely, as described above, in the magnetic ion oxide used in the present invention, another metal element is used together with silicon element to suppress precipitation of a silicon compound in the vicinity of the surfaces of the magnetic iron oxide, and the suppression of precipitation is compensated for by another metal. Therefore, it is possible to keep down hygroscopicity without deteriorating the effect of improving the fluidity of the magnetic iron oxide. Furthermore, the use of polypropylene wax having a specified acid value improves the dispersibility of the wax in the binder resin so that the wax functions as a plasticizer for the binder resin to decrease the melt viscosity of the toner, thereby further improving the dispersibility of the magnetic iron oxide in the toner. As a result, the fluidity of the toner can more effectively be improved, and thus the uniformity of the toner coat is improved over the whole region of the development sleeve, thereby maintaining a high image density even at the image ends. Particularly, even when the toner contained in a toner container is weakly agitated and transferred to the development sleeve, the toner is sufficiently supplied to the development sleeve because of good fluidity of the toner, thereby causing no problem in development.

The polypropylene wax used in the present invention preferably has an acid value of 1 to 30 mgKOH/g, more preferably 1 to 15 mgKOH/g, most preferably 1 to 10 mgKOH/g.

With an acid value of less than 1 mgKOH/g, it is difficult to obtain sufficient dispersibility of the wax in the toner. With an acid value of over 30 mgKOH/g, the wax exhibits high agglomeration and thus deteriorates the fluidity and development performance of the toner.

The polypropylene wax used in the present invention preferably shows an endothermic peak at 130° C. or less in DSC measurement. With an endothermic peak at 130° C. or more, the softening point of the toner is lowered, and the dispersibility of the magnetic material is further improved.

In the polypropylene wax used in the present invention, the content of the ethylene component is 3% by weight or more, preferably 3 to 20% by weight, more preferably 3 to 10% by weight. With the ethylene component at a content of over 3% by weight, the degree of crystallization of the wax is decreased, and the dispersibility of the wax in the toner is improved so that the wax functions as a plasticizer for the binder resin, thereby further improving the dispersibility of the magnetic material.

Examples of the polypropylene wax used in the present invention include propylene copolymers, and copolymers of propylene and other olefin (particularly, ethylene s preferable).

As an acid monomer used for modifying the polypropylene wax used in the present invention include, a monomer containing at least one of carboxyl group, carboxylic anhydride group, and carboxylate group. Examples of such monomers include acrylic acid and α- or β-alkyl derivatives thereof such as acrylic acid, methacrylic acid, α-ethylacrylic acid, crotonic acid, and the like; unsaturated dicarboxylic acids and monoester derivatives or anhydrides thereof, such as fumaric acid, maleic acid, citraconic acid, and the like. These acid monomers can be used independently or in a mixture.

Particularly, it is possible to use polypropylene wax modified with at least one acid monomer selected from maleic acid, maleic acid half ester, and maleic anhydride.

The polypropylene wax preferably has a weight average molecular weight of 50,000 or less, and is preferably contained in the magnetic toner particles in an amount of 0.5 to 20 parts by weight based on 100 parts by weight of the binder resin.

With the polypropylene wax at a content of over 20 parts by weight, the chargeability of the toner deteriorates, while the polypropylene wax at a content of less than 0.5 part by weight, the wax exhibits no effect.

In the present invention, besides the wax having an acid value, wax having no acid value can be combined. The wax component having no acid value preferably has a weight average molecular weight of 50,000 or less, and is preferably contained in the magnetic toner particles in a content of 0.5 to 20 parts by weight based on 100 parts by weight of the binder resin.

The magnetic toner of the present invention may further contain as a coloring material a conventional known pigment or dye such as carbon black, copper phthalocyanine, or the like.

The magnetic toner of the present invention may contain a charge controlling agent according to demand. For a negatively charged toner, a negative charge controlling agent such as a metal complex of a monoazo dye, a metal complex of salicylic acid, alkylsalicyic acid, dialkylsalicylic acid or naphthoic acid is used.

For a positively charged toner, a positive charge controlling agent such as a nigrosine compound, an organic quaternary ammonium salt, or the like is used.

In the magnetic toner of the present invention, an inorganic fine powder or hydrophobic inorganic fine powder is preferably mixed with the magnetic toner particles. Examples of such inorganic fine powders include a silica fine powder and titanium oxide fine powder. These powders are preferably used independently or in a combination.

As the silica fine powder used in the present invention, it is possible to use both so-called dry silica produced by vapor phase oxidization of a silicon halide compound or dry silica referred to as "fumed silica" and so-called wet silica produced by water glass. However, it is preferable to use dry silica having less silanol groups in the surface and inside, and no production residue.

The silica fine powder used in the present invention may be further subjected to hydrophobic treatment. The hydrophobic treatment is preferably effected by chemically treating the silica fine powder with a treatment agent such as an organosilicic compound which reacts with or physically adsorbs the silica fine powder. Preferable examples of the hydrophobic treatment method include a method comprising treating the dry silica fine powder produced by vapor phase oxidization of a silicon halide compound with a silane coupling agent, and then treating with an organosilicic compound such as silicone oil, and a method comprising treating with a silane coupling agent and, at the same time, treating with an organosilicic compound such as silicone oil.

Examples of the silane coupling agent used for hydrophobic treatment include hexamethylsilane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosialne, α-chloroethyltrichlorosilane, β-chloroethyltrichlorosilane, chloromethyldimethylchlorosilane, triorganosilane mercaptan, trimethylsilyl mercaptan, triorganosilyl acrylate, vinyldimethylacetoxysilane, dimethylethoxysilane, dimethyldimethoxysilane, diphenyldiethoxysilane, hexamethyldisiloxne, 1,3-divinyltetramethyldisiloxane, 1,3-diphenyltetramethyldisiloxane, and the like.

An organosilicic compound used for hydrophobic treatment is silicone oil. As the silicone oil, silicone oil having a viscosity of about 30 to 1,000 centistokes at 25° C. is preferably used. Preferable examples of such silicone oil include dimethyl silicone oil, methylphenyl silicone oil, methylstyrene modified silicone oil, chlorophenyl silicone oil, and fluorine-modified silicone oil.

Examples of the silicone oil treatment method include a method of directly mixing the silica fine powder treated with a silane coupling agent and silicone oil by using a mixer such as a Henschel mixer or the like, a method of jetting silicone oil to silica used as a base, and a method comprising dissolving or dispersing silicone oil in an appropriate solvent, mixing the silicone oil with silica fine powder used as a base, and then removing the solvent.

In a preferred form of hydrophobic treatment of the silica fine powder used in the present invention, the silica fine powder is treated with dimethylchlorosilane, hexamethyldisilane, and then silicone oil.

This treatment of the silica fine powder with at least two silane coupling agents and then silicone oil can effectively improve the degree of hydrophobicity.

Like the silica system, a titanium oxide fine powder subjected to the same hydrophobic treatment and oil treatment as the silica fine powder can preferably be used in the present invention.

The inorganic fine power or hydrophobic inorganic fine powder mixed with the magnetic toner particles is preferably used in an amount of 0.1 to 5.0 parts by weight, more preferably 0.1 to 3.0 parts by weight, based on 100 parts by weight of magnetic toner particles.

The magnetic toner of the present invention may contain external additives other than the silica fine powder according to demand.

Examples of such external additives include resin fine particles and inorganic fine particles serving as a charge auxiliary, a conductivity additive, a fluidity additive, an anti-caking agent, a releasing agent used in thermal roll fixing, a lubricant, an abrasive, or the like.

The resin fine particles used preferably have a number average particle diameter of 0.03 to 1.0 μm based on the measurement method, which will be described below. Examples of polymerizable monomers which constitute the resin include styrene monomers such as styrene, o-methylstyrene, m-methylstyrene, p-methylstyrene, p-methoxystyrene, p-ethylstyrene, and the like; acrylic acid; acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate, and the like; methacrylic acid; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, steary methacrylate, phenyl methacrylate, dimethylaminoethyl methacrylate, diethylaminoethyl methacrylate, and the like; acrylonitrile; methacrylonitrile; acrylamide; and the like.

As the method of polymerizing the above monomers for the resin fine particles, suspension polymerization, emulsion polymerization, and soap free polymerization can be used. However, the particles obtained by soap free polymerization are preferably used.

Particularly, when a contact charging unit such as a roller, a brush, a blade or the like is used as a charging member for primarily charging the latent image holding member such as a photosensitive drum or the like, the resin fine particles having the above characteristics have the significant effect of suppressing fusion to the drum.

Examples of inorganic fine particles include lubricants such as zinc stearate, cerium oxide, silicon carbide, strontium titanate, and the like (preferably strontium titanate); fluidity additives such as titanium oxide, aluminum oxide, and the like (preferably hydrophobic particles; anti-caking agents such as carbon black, zinc oxide, antimony oxide, and the like; conductivity additives such as tin oxide, and the like; development improvers such as reverse-polarity white fine particles, black fine particles, and the like. Small amounts of these inorganic fine particles can be used.

As described above, the magnetic toner containing the magnetic toner particles and additives is used in some cases. As obvious from the method of measuring the particle size distribution of the magnetic toner, which will be described below, the particles having a particle size of 2 $\mu$m or more are measured in measurement of the particle size distribution of the magnetic toner. However, since the additives generally have a particle size smaller than that of the particles measured, and are added in small amounts, the particle size distribution is substantially the same before and after addition of the additives to the magnetic toner particles.

In order to produce the magnetic toner for developing the electrostatic latent image in the present invention, magnetic iron oxide, a vinyl or non-vinyl thermoplastic resin, and if required, a pigment or dye as a colorant, a charge controller, and other additives are sufficiently mixed in a mixer such as a ball mill or the like, and the resultant mixture is then melted and kneaded by using a heat kneader such as a heating roll, a kneader, an extruder, or the like to disperse or dissolve magnetic iron oxide and the pigment or dye in the resins compatible with each other, followed by cooling, grinding and then strict classification to obtain the magnetic toner of the present invention.

As another method for obtaining the magnetic toner of the present invention, a polymerization method can be used for producing the toner. In this polymerization method, a polymerizable monomer, magnetic iron oxide, a polymerization initiator (if required, a cross-linking agent, a charge controller and other additive) are uniformly dissolved or dispersed to prepare a monomer composition, and the monomer composition or the monomer composition which has previously be polymerized is dispersed in a continuous phase (e.g., water) containing a dispersion stabilizer by using an appropriate agitator, and at the same time, subjected to polymerization reaction to produce the toner particles having a desired particle diameter. In the polymerization method, the magnetic iron oxide used in the present invention is preferably previously subjected to hydrophobic treatment.

Description will now be made of the construction and production method of the magnetic iron oxide used in the present invention.

In the magnetic iron oxide used in the present invention, the silicon element and another metal element contained are basically present in both the inside and the surface of the magnetic iron oxide.

As a result of examination of the distribution of the internal metal elements of the magnetic iron oxide by a dissolving method using an acid in examples of the present invention, it was found that the silicon element and another metal element are present in a region from the center of the magnetic iron oxide to the surface thereof, and the contents gradually increase toward the surface.

The magnetic iron oxide containing the silicon element of the present invention is produced by, for example, the method below. To an aqueous ferrous salt solution are added predetermined amounts of a salt of at least one metal selected from Mn, Zn, Ni, Cu, Co, Cr, Cd, Al, Sn and Mg, and silicate, and an alkali such as sodium hydroxide or the like is added to the resultant mixture in an amount equivalent to or more the iron component to prepare an aqueous solution containing ferrous hydroxide. Air is blown into the thus-prepared aqueous solution with the pH maintained at pH 7 or more (preferably pH 8 to 10), and ferrous hydroxide is oxidized under heating of the aqueous solution to 70° C. or more to produce seed crystals as cores of the magnetic iron oxide particles.

Next, to a slurry solution containing the seed crystals is added an aqueous solution containing about one equivalent of ferrous sulfate based on the amount of the alkali previously added. Reaction of ferrous hydroxide is allowed to proceed by blowing air with the pH maintained at 6 to 10 to grow the magnetic iron oxide particles with the seed crystals as the cores. Although the pH is transferred to the acid side as oxidation reaction proceeds, the pH of the solution is preferably adjusted to 6 or more. The pH of the solution is preferably adjusted in the final stage of oxidation reaction to localize predetermined amounts of another metal compound in both the surface layers and the surfaces of the magnetic iron oxide particles.

Examples of the silicate added include sodium silicate and potassium silicate. Examples of the salt of a metal added as a metal other than iron include a sulfate, a nitrate, and a chloride.

As the ferrous salt, iron sulfate secondarily produced in titanium production by a sulfuric acid method, and iron sulfate secondarily produced in washing the surface of a copper plate can be used. Also, iron chloride and the like can be used.

In the aqueous solution method of producing magnetic iron oxide, in order to prevent an increase in viscosity during reaction, the iron concentration is 0.5 to 2 mol/l from the viewpoint of solubility of iron sulfate. As the concentration of iron sulfate decreases, the particle size of the product decreases. In reaction, as the amount of the air used increases, and the reaction temperature decreases, the particle size decreases.

As a result of observation by a transmission electron microscope photograph, it was found that the magnetic iron oxide particles produced by the above production method and containing the silicon element and another metal element comprises spherical particles having curved surfaces without plate surfaces, and hardly comprises octahedral particles. Such a magnetic iron oxide is preferably used for the magnetic toner.

The methods of measuring data of various physical properties in the present invention are described in detail below.

(1) Amount of Metal Element

In the present invention, the content (based on the iron element) of a metal element other than iron contained in the magnetic iron oxide, the solubility of the iron element and the content of the metal element other than iron relative to the iron element solubility can be determined by the following methods. For example, to a 5 liter beaker is added about 3 liter of deionized water, followed by heating to 45 to 50° C. in a water bath. To the 5 liter beaker is added about 400 ml of deionized water slurry containing about 25 g of magnetic iron oxide together with about 300 ml of deionized water used for washing.

Next, guaranteed hydrochloric acid or a acid mixture of hydrochloric acid and hydrofluoric acid is added to the beaker at a temperature and agitation speed which are maintained at about 50° C. and about 200 rpm, respectively, to start dissolution. At this time, the concentration of the aqueous hydrochloric acid solution is about 3 N. During the time from the start of dissolution to completion of dissolution to form a transparent solution, about 20 ml of solution is sampled several times, and filtered with a 0.1-$\mu$ membrane filter to collect a filtrate. For the filtrate, the amounts of the iron element and the metal element other than iron are determined by plasma emission spectroscopy (ICP).

The iron element solubility of each of the samples is calculated by the following equation:

$$\text{Iron element Solubility (\%)} = \frac{\text{Concentration of iron element of sample (ml/g)}}{\text{Concentration of iron element of sample at the time of completion of dissolution (ml/g)}} \times 100$$

The content of the metal element other than the iron element in each of the samples is calculated by the following equation:

$$\text{Content of metal element other than iron element (\%)} = \frac{\text{Concentration of metal element other than iron element (ml/g)}}{\text{Concentration of iron element (ml/g)}} \times 100$$

The total content A of the metal element other than the iron element in magnetic iron oxide corresponds to the metal element concentration (mg/l) per unit weight of magnetic iron oxide after complete dissolution.

The contents B and C of the metal element other than the iron element in magnetic iron oxide correspond to the concentrations (mg/l) of the metal element other than the iron element per unit weight of magnetic iron oxide with solubilities of magnetic iron oxide of 20% and 10%, respectively.

(2) Bulk Density of Magnetic Iron Oxide

The bulk density of the magnetic iron oxide particles in the present invention is measured in accordance with the pigment test method of JIS-K-5101.

(3) Spheroidicity of Magnetic Iron Oxide

The spheroidicity of magnetic iron oxide of the present invention is calculated by the following equation.

$$\text{Spheroidicity } \phi = \frac{\text{Minimum length of magnetic iron oxide particles } (\mu m)}{\text{Minimum length of magnetic iron oxide particles } (\mu m)}$$

For the spheroidicity (ϕ), a sample of treated magnetic iron oxide in a collodion film copper mesh is photographed at the applied voltage of 100 kV and a magnification of ×10000 by an electron microscope (produced by Hitachi, Ltd., H-700H), and printed at a magnification of ×3 to obtain a photograph at a final magnification of ×30000. The shape of the magnetic iron oxide is observed by using the thus-obtained photograph. Namely, 100 specimens of magnetic iron oxide particles are randomly selected, the maximum and minimum lengths are measured, and average maximum and minimum lengths are calculated.

(4) Number Average Particle Diameter of Magnetic Iron Oxide 100 particles are randomly selected in a photograph of an electron microscope (magnification of ×30000), the diameters of the particles are measured, and an average value is calculated to obtain a number average particle diameter.

(5) Particle Size Distribution of Magnetic Toner

The particle size distribution of the toner of the present invention is measured by using Coulter counter TA-II model or Coulter multianalyzer (produced by Coulter Corp.). As an electrolyte, a 1% aqueous NaCl solution is prepared by using an extra pure reagent of sodium chloride. For example, ISOTON R-II (produced by Coulter Scientific Japan Co.) can be used. As a measurement method, to 100 to 150 ml of the electrolytic aqueous solution is added a surfactant as a dispersant, preferably 0.1 to 5 ml of alkylbenzene sulfonate, and 2 to 20 mg of measurement sample is added to the mixture. The electrolyte containing the sample suspended therein is dispersed by an ultrasonic disperser for about 1 to 3 minutes, and then the volume and number of toner particles of 2 μm or more are measured by using the above measurement apparatus with an aperture of 100 μm to calculate the volume distribution and number distribution.

Then, the weight average particle diameter (D4) based on weight, the volume average particle diameter (Dv) (the central value of each of channels is considered as the typical value of each channel), and the ratio of the particles having a diameter of 12.7 μm or more are determined from the volume distribution, and the content of the magnetic toner particles having a diameter of less than 4.0 μm is determined from the number distribution.

(6) Acid Value of Wax

The acid value of wax is determined by the following method:

Fractionation of Wax Components 0.5 to 1.0 g of toner sample is weighed and placed in a cylindrical filter (for example, NO. 86R produced by Toyo Filter), followed by extraction using a Soxhlet extractor and 100 to 200 ml of toluene as a solvent for 20 hours. The solvent of the eluate containing a soluble component is evaporated, and then the residue is dried at 100° C. under vacuum for several hours. To the thus-obtained extract is added 20 ml of chloroform, and the resultant mixture is allowed to stand for 1 hour, filtered with a membrane filter having a pore size of 0.45 μm, followed by drying to obtain a wax component.

Measurement of Acid Value

Apparatus and tool

- Direct-reading balance
- Conical flask (200 ml)
- Measuring cylinder (100 ml)
- Microburette (10 ml)
- Electric heater Reagent

- Xylene
- Dioxane
- N/10 standard methanol solution of potassium hydroxide
- 1% phenolphthalein solution (indicator)

Measurement method 1 to 1.5 g of wax is precisely weighed in a conical flask, and 20 ml of xylene is added to the flask, followed dissolution under heating. After dissolution, 20 ml of dioxane is added to the solution, and titration is carried out as early as possible by using the N-10 standard methanol solution of potassium hydroxide and the 1% phenolphthalein solution as an indicator before the solution clouds or hazes. At the same time, a blank test is carried out.

Calculation equation $$\text{Acid value} = \frac{5.61 \times (A - B) \times f}{S}$$

wherein

A: Amount (ml) of the standard methanol solution of N/10 potassium hydroxide required for the run proper B: Amount (ml) of the standard methanol solution of N/10 potassium hydroxide required for the blank test f: Factor of the standard methanol solution of N/10 potassium hydroxide S: Sample (g)

(7) Endothermic Peak in DSC Measurement of Wax

In DSC measurement, behavior is observed by heat transfer, and thus measurement must be performed by an inner heat-type input compensation differential scanning calorimeter with high precision from the viewpoint of measurement principle. For example, DSC-7 produced by Perkin Elmer Co. can be used.

Measurement is carried out in accordance with ASTM D3418-82. In the present invention, a DSC curve is measured by increasing the temperature to measure pre-history, and then decreasing and increasing the temperature at a temperature rate of 10° C./min in the temperature range of 0 to 200° C. The endothermic peak temperature represents the peak temperature in the plus direction in the DSC curve, i.e., the point in the peak curve in which the differential value is zero in change from a positive value to negative value.

(8) Content of Ethylene Component in Wax

The content of the ethylene component in wax can be measured by composition analysis using a nuclear magnetic resonance apparatus ($^{13}$C-NMR).

Specifically, measurement can be carried out by using, for example, 400-MHz EX 400 FT-NMR apparatus produced by Nihon Electronics Co., Ltd. under the following conditions:

Measurement frequency: 100.40 MHz

Pulse condition: 5.0 $\mu$s (45) DEPT method

Data points: 32768

Delay time: 25 sec

Frequency range: 10500 Hz

Number of times of integration: 10000

Measurement temperature: 110° C.

Sample: Prepared by placing 200 mg of measurement sample in a sample tube having a diameter of 10 mm, adding benzene-$d_6$/o-dichlorobenzene-$d_4$ (1/4) as solvents to the sample tube, and then dissolving the sample in a constant-temperature bath of 110° C.

The content of the ethylene unit is calculated from the integral value of the peak due to a difference in chemical shift accompanied with a difference in carbon bond between the measured methine and methylene groups in molecules.

(9) Number Average Particle Diameter of Resin Fine Particles 100 particles having a diameter of 0.005 $\mu$m or more are randomly selected in an enlarged electron microscope photograph (×10000) of the resin fine particles, the diameters of the particles are measured, and the calculated average value is considered as the number average particle diameter of the resin fine particles.

A preferable example of the image forming method of the present invention is described with reference to FIG. 1.

The surface of an OPC photosensitive drum 3 serving as an electrostatic latent image holding member is charged to negative polarity by a contact charging member 11 comprising a charging roller as a primary charging unit, and the image is scanned by exposure 5 using a laser beam to form a digital latent image. The latent image is reversed and developed by a negative frictional chargeable magnetic toner 13 of a development unit 1 as development means provided in the counter direction and comprising an urethane rubber elastic blade 8 and a development sleeve 6 as a toner carrying member containing a magnet 15. Alternatively, an amorphous silicon photosensitive member used as the electrostatic latent image holding member is charged to positive polarity to form an electrostatic latent image, and the latent image is normally developed by using a negative frictional chargeable polar toner.

The fill amount of the toner in the development unit is generally 100 to 900 g. However, the present invention can be applied to cases in which the development unit is filled with a large amount of the toner, e.g., 1000 to 4000 g, as compared with the fill amount of ordinary development units.

An alternate bias, a pulse bias and/or a DC bias is applied to the development sleeve 6 by bias applying means 12. When transfer paper P is conveyed to the transfer unit, the back side (opposite to the photosensitive drum side) of the transfer paper P is charged by a contact transfer member 4 comprising a transfer roller serving as transfer means to electrostatically transfer the toner image on the photosensitive drum onto the transfer paper P. The transfer paper P separated from the photosensitive drum 3 is subjected to fixing processing for fixing the toner image on the transfer paper P by a heating pressure fixing unit comprising a heating roller 21 having heating means 20 therein and a pressure roller 22.

The magnetic toner remaining on the photosensitive drum 3 after the transfer step is removed by a cleaning unit 14 comprising a cleaning blade 7. After cleaning, the photosensitive drum 3 is destaticized by erase exposure 10, and the process starting from the charging step by the primary charger 11 is gain repeated.

The electrostatic latent image holding member (photosensitive drum) comprises a photosensitive layer and a conductive substrate, and is moved in a direction shown by an arrow. In the development unit, the nonmagnetic cylindrical development sleeve 6 serving as the toner carrying member is rotated in the same direction as the surface of the electrostatic latent image holding member. In the nonmagnetic cylindrical development sleeve 6 is nonrotatably disposed the multipolar permanent magnet 15 (magnet roll) serving as magnetic field generating means. In the development device 1, the magnetic toner 13 is coated on the development sleeve 6, and the magnetic toner particles are provided with negative tribo charge by friction between the surface of the development sleeve 6 and the magnetic toner particles. The elastic blade 8 is disposed for controlling the toner layer to be thin (thickness of 30 to 300 $\mu$m) and uniform to form in a non-contact state the toner layer thinner than the space between the photosensitive drum 3 and the development sleeve 6 in the region of the development unit where the photosensitive drum and the development sleeve are opposite to each other. The rotational speed of the development sleeve 6 is controlled so that the surface speed of the toner carrying member is substantially the same or close to the surface speed of the electrostatic latent image holding member.

An AC bias or pulse bias may be applied to the development sleeve 6 by the bias applying means 12. The AC bias preferably has f of 200 to 4,000 Hz and Vpp of 500 to 3,000 V.

In transfer of the magnetic toner from the toner carrying member to the electrostatic latent image holding member in the development unit, the magnetic toner is transferred to the electrostatic latent image holding member side by the action of the electrostatic force of the surface of the electrostatic latent image holding member for holding the electrostatic latent image, and the AC bias or pulse bias.

Of the constituent components such as the electrostatic latent image holding member such as the photosensitive drum, the development unit, the primary charging means, the cleaning means, etc., a plurality of components may be integrally combined to form a process cartridge as an apparatus unit, and the process cartridge may be detachably mounted on the main assembly of the apparatus. For example, the primary charging means and the development device may be integrally supported together with the photosensitive drum to form the process cartridge as a single unit detachable from the main assembly so that the process cartridge is detachably mounted on the main assembly by using guide means such as a rail or the like. In this case, the cleaning means may be provided on the process cartridge.

Figure 2:
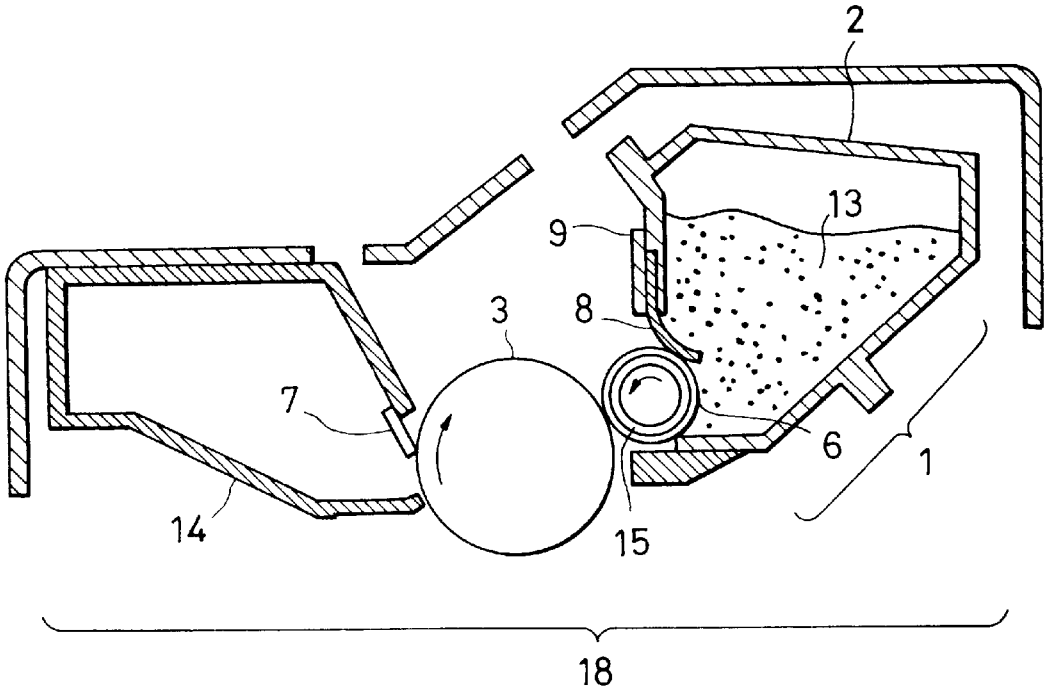
FIG. 2 is a schematic drawing illustrating a process cartridge of the present invention.

FIG. 2 shows a process cartridge in accordance with an embodiment of the present invention. In this embodiment, a development unit 1, a drum-shaped electrostatic latent image holding member (photosensitive drum) 3, a cleaner 14, and a primary charger 11 are integrated to form a process cartridge 18.

This process cartridge 18 is changed by a new cartridge when the magnetic toner 13 of the development device 1 is used up.

In this embodiment, the development device 1 comprises the magnetic toner 13, and forms a predetermined electric field between the photosensitive drum 3 and the development sleeve 6. The distance between the photosensitive drum 3 and the development sleeve 6 is very important for preferably performing the development step. In this embodiment, the distance is adjusted to, for example, 300 μm with an error of 20 μm.

In the process cartridge shown in FIG. 2, the development device 1 comprises a toner container 2 for containing the magnetic toner 13, the development sleeve 6 for carrying the magnetic toner 13 in the toner container 2 from the toner container 2 to the development region (unit) opposite to the electrostatic latent image holding member 3, and an elastic blade 8 carried by the development sleeve 6 and serving as a toner layer thickness regulating member for regulating the thickness of the magnetic toner carried to the development region to a predetermined thickness to form the toner thin layer on the development sleeve 6.

The development sleeve 6 may have any desired structure. Generally, the development sleeve 6 comprises a nonmagnetic development sleeve containing a magnet 15. As shown in FIG. 2, the development sleeve 6 may comprise a cylindrical rotatable member or a circularly moving belt. As the material for the development sleeve 6, aluminum or SUS is generally preferably used.

The elastic blade 8 comprises an elastic plate made of a rubber elastic material such as urethane rubber, silicone rubber, NBR, or the like; a metal elastic material such as phosphor bronze, stainless, or the like; or a resin elastic material such as polyethylene terephthalate, high-density polyethylene, or the like. The elastic blade 8 is brought into contact with the development sleeve 6 by the elasticity possessed by the elastic blade 8, and is fixed to the toner container 2 by a blade supporting member 9 comprising a rigid material such as iron or the like. The elastic blade 8 is preferably brought into contact with the development sleeve 6 carrying the magnetic toner under linear pressure of 5 to 80 g/cm in the counter direction relative to the rotation direction of the development sleeve 6.

As the contact charging member, a blade-shaped charging blade can be used in place of the above charging roller.

Figure 3:
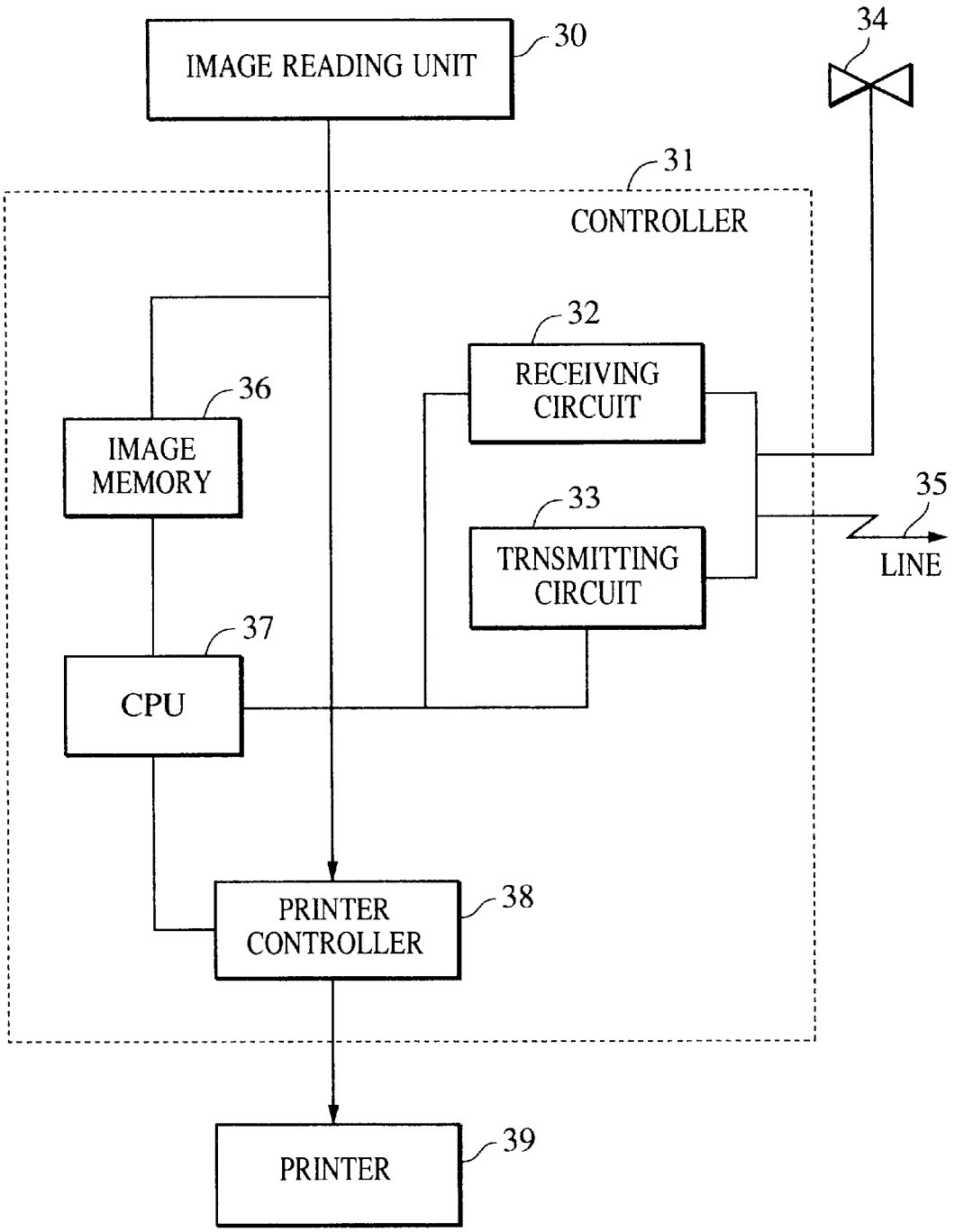
FIG. 3 is a block diagram illustrating a printer of a facsimile apparatus to which an image forming method of the present invention is applied.

In application of the image forming method of the present invention to the printer of a facsimile, light image exposure L is exposure for printing received data. FIG. 3 is a block diagram showing an example of this application.

A controller 31 controls an image reading unit 30 and a printer 39. The entire controller 31 is controlled by CPU 37. The read data from the image reading unit 30 is transmitted to an opposite party through a transmitting circuit 33. The data received from the opposite party is sent to the printer 39 through a receiving circuit 32. In an image memory is stored predetermined image data. A printer controller 38 controls the printer 39. This example further comprises a telephone 34.

The image (image information from a remote terminal connected through the line) received through a line 35 is demodulated by the receiving circuit 32, decoded by the CPU 37 and then successively stored in the image memory 36. When an image of at least one page is stored in the memory 36, the image of this page is recorded. The CPU 37 reads the image information of one page from the memory 36, and sends the decoded image information of one page to the printer controller 38. When the printer controller 38 receives the image information from the CPU 37, the printer controller 38 controls the printer 39 to record the image information of the page.

The CPU 37 receives information of a next page during recording by the printer 39.

An image is received and recorded as described above.

As described above, even when the magnetic toner of the present invention applied to a development unit having a high toner capacity, the magnetic toner of the present invention realizes formation of a uniform image having excellent quality without fading and fogging, exhibits high development performance and excellent long-term durability in each of environments of low temperature and low humidity and high temperature and high humidity.

EXAMPLE

The present invention is described in detail below with reference to production examples and examples.

In the examples, "parts" and "%" represent "parts by weight" and "% by weight", respectively, unless stated otherwise.

Production of Magnetic Iron Oxide 1

Production Example 1

To an aqueous ferrous sulfate solution was added sodium silicate so that the silicon element content was 1.8% based on the iron element, and zinc sulfate was further added so that the zinc element content was 0.6% based on the iron element. Then sodium hydroxide solution was mixed in an amount of 1.0 to 1.1 equivalent based on iron ions to prepare an aqueous solution containing ferrous hydroxide.

Air was blown into the aqueous solution at the pH maintained at 7 to 10 (for example pH 9), followed by oxidation reaction at 80 to 90° C. to prepare a slurry solution for generating seed crystals.

Then, to this slurry solution was added an aqueous ferrous sulfate solution so that the content was 0.9 to 1.2 equivalents to the initial alkali amount (the sodium component and sodium silicate and the sodium component of sodium hydroxide). Air was blown into the slurry solution to allow oxidation reaction to proceed at the pH maintained at 6 to 10 (for example pH 8), and the pH was adjusted in the final state of the oxidation reaction to localize silicate component and zinc component in the surfaces of the magnetic iron oxide particles. The thus-produced magnetic iron oxide particles were washed, filtered off, and dried by a normal method, and then agglomerates were cracked to obtain magnetic iron oxide A.

For the thus-obtained magnetic iron oxide A, the relations between the iron element and the solubility of the silicon element and other metal elements, and characteristics thereof are shown in Table 1.

Production Examples 2 to 7

Magnetic iron oxides B to G having the characteristics shown in Table 1 were obtained by the same method as Production Example 1 except that the amount of sodium silicate and the amounts of other metal salts added were changed as shown in Table 1.

Comparative Production Example 1

Magnetic iron oxide a having the characteristics shown in Table 1 was obtained by the same method as Production Example 1 except that neither sodium silicate nor zinc sulfate were added.

Comparative Production Example 2

0.7 part by weight of silicate fine powder was mixed with 100 parts by weight of magnetic iron oxide obtained by Comparative Production Example 1 by using a Henschel mixer to obtain magnetic iron oxide b having the characteristics shown in Table 1.

Comparative Production Example 3

Magnetic iron oxides c to j having the characteristics shown in Table 1 were obtained by the same method as Production Example 1 except that the amount of sodium silicate and the amounts of other metal salts added were changed as shown in Table 1.

TABLE 1

| Production example No. | Magnetic iron oxide | Silicon element content (%) | $(B_{Si}/A_{Si}) \times 100$ (%) | $(C_{Si}/A_{Si}) \times 100$ (%) | Manganese element content (%) | $(B_{Mn}/A_{Mn}) \times 100$ (%) | Zinc element content (%) | $(B_{Zn}/A_{Zn}) \times 100$ (%) |
|---|---|---|---|---|---|---|---|---|
| Example | | | | | | | | |
| 1 | A | 0.6 | 72 | 60 | — | — | 0.6 | 67 |
| 2 | B | 0.5 | 61 | 51 | 1.2 | 76 | 0.6 | 85 |
| 3 | C | 0.7 | 69 | 59 | — | — | — | — |
| 4 | D | 0.6 | 55 | 45 | 1.2 | 74 | 0.5 | 85 |
| 5 | E | 0.7 | 67 | 57 | — | — | — | — |
| 6 | F | 0.5 | 60 | 42 | 1.3 | 72 | 0.6 | 90 |
| 7 | G | 0.5 | 77 | 58 | — | — | — | — |

| Production example No. | Copper element content (%) | $(B_{Cu}/A_{Cu}) \times 100$ (%) | Nickerl element content (%) | $(B_{Ni}/A_{Ni}) \times 100$ (%) | Bulk density (g/cm) | Spheroidicity $\phi$ | Number average particle diameter ($\mu$m) |
|---|---|---|---|---|---|---|---|
| Example | | | | | | | |
| 1 | — | — | — | — | 0.56 | 0.90 | 0.23 |
| 2 | 0.4 | 98 | — | — | 0.57 | 0.93 | 0.22 |
| 3 | 0.5 | 98 | — | — | 0.56 | 0.83 | 0.18 |
| 4 | — | — | — | — | 0.59 | 0.83 | 0.19 |
| 5 | — | — | 0.5 | 61 | 0.58 | 0.91 | 0.22 |
| 6 | — | — | 0.5 | 98 | 0.57 | 0.91 | 0.24 |
| 7 | — | — | 0.5 | 30 | 0.66 | 0.90 | 0.24 |

| Production example No. | Magnetic iron oxide | Silicon element content (%) | $(B_{Si}/A_{Si}) \times 100$ (%) | $(C_{Si}/A_{Si}) \times 100$ (%) | Manganese element content (%) | $(B_{Mn}/A_{Mn}) \times 100$ (%) | Zinc element content (%) | $(B_{Zn}/A_{Zn}) \times 100$ (%) |
|---|---|---|---|---|---|---|---|---|
| Comp. Example | | | | | | | | |
| 1 | a | — | — | — | — | — | — | — |
| 2 | b | * | 100 | 100 | — | — | — | — |
| 3 | c | 0.8 | 75 | 65 | — | — | — | — |
| 4 | d | — | — | — | 1.8 | 75 | — | — |
| 5 | e | 1.1 | 77 | 65 | — | — | — | — |
| 6 | f | 0.1 | 48 | 36 | 1.9 | 61 | — | — |
| 7 | g | 0.5 | 70 | 66 | — | — | — | — |
| 8 | h | 0.6 | 81 | 69 | 0.3 | 48 | — | — |
| 9 | i | 0.6 | 96 | 88 | — | — | — | — |
| 10 | j | 0.3 | 23 | 15 | — | — | 0.3 | 51 |

TABLE 1-continued

| Production example No. | Copper element content (%) | $(B_{Cu}/A_{Cu}) \times 100$ (%) | Nickerl element content (%) | $(B_{Ni}/A_{Ni}) \times 100$ (%) | Bulk density (g/cm) | Spheroidicity φ | Number average particle diameter (μm) |
|---|---|---|---|---|---|---|---|
| Comp. Example | | | | | | | |
| 1 | — | — | — | — | 0.62 | 0.83 | 0.23 |
| 2 | — | — | — | — | 0.65 | 0.83 | 0.24 |
| 3 | — | — | — | — | 0.48 | 0.82 | 0.19 |
| 4 | — | — | — | — | 0.55 | 0.88 | 0.22 |
| 5 | — | — | 0.2 | 50 | 0.58 | 0.90 | 0.24 |
| 6 | — | — | — | — | 0.61 | 0.91 | 0.22 |
| 7 | 1.1 | 83 | — | — | 0.66 | 0.89 | 0.20 |
| 8 | — | — | — | — | 0.59 | 0.88 | 0.25 |
| 9 | 0.08 | 88 | — | — | 0.63 | 0.91 | 0.17 |
| 10 | — | — | — | — | 0.67 | 0.87 | –.17 |

*: 0.7% Henschel mixing

Production of Toner I

Example 1

Styrene-n-butyl acrylate copolymer (copolymerization weight ratio=70:30, Mw=300,000, Tg=60° C.) 100 parts Magnetic iron oxide A of Production Example 1 100 parts Negative charge controlling agent represented by the following formula: 2 parts

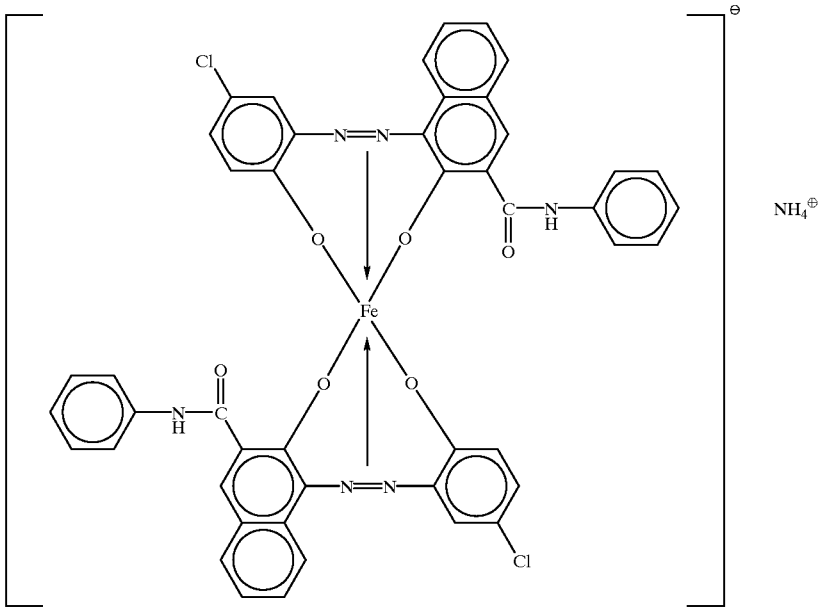

Low-molecular-weight polypropylene 3 parts

A mixture of the above components was melted and kneaded by a biaxial extruder heated to 140° C., and then cooled. The kneaded mixture was coarsely ground by a hammer mill, and then finely ground by a jet mill to obtain a finely-ground powder. The finely-ground powder was classified by a fixed wall type pneumatic classifier to produce classified powder. The thus-obtained classified powder was strictly classified by a multi-division classifier (Produced by Nittetsu Kogyo Co., Erbojet Classifier) employing a Coanda effect to remove ultrafine powder and coarse powder, to obtain negative chargeable magnetic toner particles having a weight average particle diameter (D4) of 6.7 μm, and a volume average particle diameter (D1) of 5.25 μm, and containing 0.2% of magnetic toner particles having a particle diameter of 12.7 μm or more and 20.5% of magnetic toner particles having a particle diameter of less than 4.0 μm (diameter of 2.0 to 4.0 μm).

100 parts of the magnetic toner particles, 1.2 parts of hydrophobic silica fine powder (BET 300 $m^2/g$) which was treated with hexamethyldisilane and then treated with dimethyl silicone oil, and 0.08 part of styrene-acrylic fine particles (average particle diameter 0.05 μm) obtained by soap free polymerization were mixed by a Henschel mixer to prepare negative chargeable magnetic toner 1.

Print Out Test

The image forming apparatus shown in FIG. 1 was used, in which a laser beam printer Laser shot 930 produced by Canon Inc. was modified from 24 sheets/min to 32 sheets/min. The process cartridge shown in FIG. 2 was modified so that it can be filled with 1700 g of toner, and filled with 1700 g of the magnetic toner 1. The process cartridge filled with the external magnetic toner was mounted on the main assembly of the image forming apparatus. In this apparatus, the process speed was 145 mm/sec.

Primary charge was set to −700 V, and the space between the photosensitive drum and the magnetic toner layer on the development sleeve (containing the magnet) was set to be non-contact. An AC bias (f=2000 Hz, Vpp=1600 V) and a DC bias ($V_{DC}$=−500 V) were applied to the development sleeve to develop an electrostatic latent image with $V_L$ (the potential of the electrostatic latent image portion) of −150 V, to form a magnetic toner image on the OPC photosensitive member.

The magnetic toner image formed on the OPC photosensitive member was transferred to plain paper at the above-described plus transfer potential, and the plain paper having the magnetic toner image was passed through the roller fixing unit to fix the magnetic toner image.

At this time, the surface temperature of the heating roller of the heating pressure roller fixing unit was set to 190° C., and the total pressure between the heating roller and the pressure roller was set to 30 kg.

Under the above set conditions, a print out test was continuously carried out for 30,000 sheets at a print speed of 2 sheets/20 sec. in an environment of high temperature and high humidity (32.5° C., 85% RH), and an environment of low temperature and low humidity (10° C., 15% RH), and the obtained images were evaluated with respect to the items below.

After the print out test was carried out for 15000 sheets in an environment of high temperature and high humidity, the apparatus was allowed to stand for 2 days in the same environment, and then the print out test was further carried out for 15000 sheets.

(1) Image Density

The image density was evaluated by measuring images printed out on copying plain paper (deposit: 75 g/m$^2$). In regard to the image density, the relative density of a white portion having an original density of 0.00 to the printed out image by using a Macbeth reflection densitometer (produced by Macbeth Co.,).

(2) Uniformity of Image Density in Page

Uniformity in page was judged from a difference between the maximum and minimum image densities in a printed out image.

(3) Fogging

Fogging was calculated from a difference (Ds−Sr) between the whiteness (Dr) of transfer paper before printing and the whiteness (Ds) of transfer paper after printing of solid white, which were measured by a reflectometer (produced by Tokyo Denshoku Co., Ltd.). Images were formed in an environment of low temperature and low humidity (15° C., 10% RH), and the print mode was set to 2 sheets/20 sec.

(4) Image Quality

Figure 4:
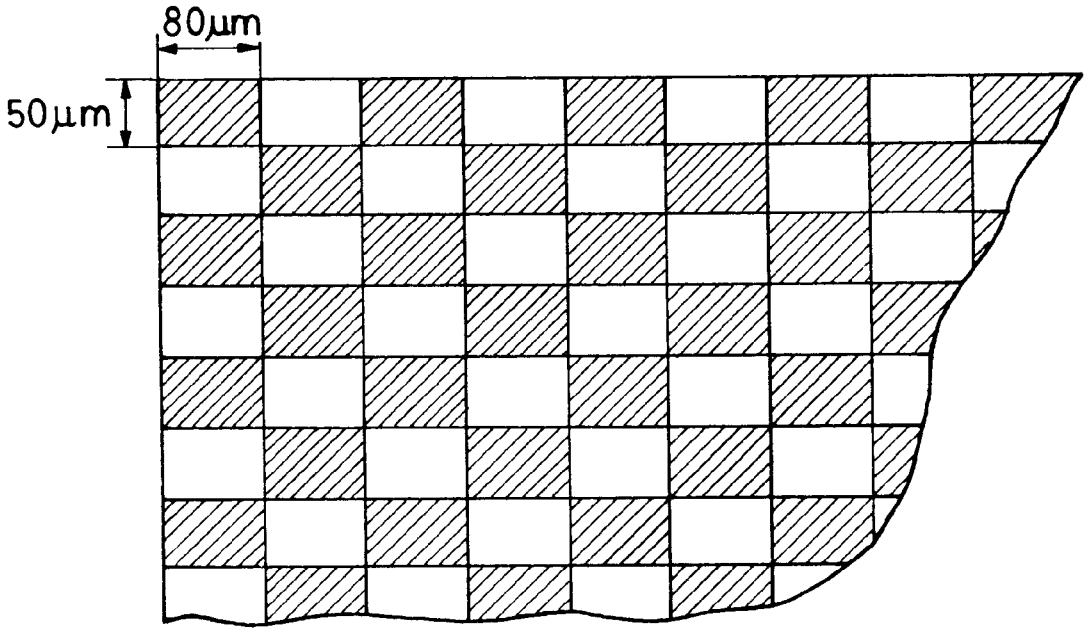
FIG. 4 is a drawing illustrating a checker pattern for testing the development properties of a magnetic toner.

The checker pattern shown in FIG. 4 was printed out, and reproducibility of dots was evaluated on the basis of the following evaluation criteria:

Evaluation Criteria

Rank 1: very good (2 defects or less/100)
Rank 2: good (3 to 5 defects/100)
Rank 3: normal (6 to 10 defects/100)
Rank 4: no good (11 defects or more/100)

The results of evaluation are shown in Table 2.

Examples 2 to 7

Magnetic toners 2 to 7 of Examples 2 to 7 were obtained by the same method as Example 1 except that magnetic iron oxides B to G of Production Examples 2 to 7 were respectively used. The magnetic toners 2 to 7 obtained were evaluated by the same method as Example 1. The results of evaluation are shown in Table 2.

Comparative Examples 1 to 10

Magnetic toners 8 to 17 were produced by the same method as Example 1 except that magnetic iron oxides a to j of Comparative Production Examples 1 to 10 were respectively used. The results of evaluation are shown in Table 2.

TABLE 2

| | Magnetic toner No. | Magnetic iron oxide | Weight average diameter of magnetic toner (m) | Content of magnetic toner particles having diameter of 12.7 μm or more (% by volume) | Content of magnetic toner particles having diameter of less than 4.0 μm (% by number) | Image density: I the morning after allowing at high temperature and high humidity | Image density: In a late stage of allowing at high temperature and high humidity | Image density: In a late stage of allowing at low temperature and low humidity | Fogging (both sides) in a late stage of allowing at low temperature and low humidity | Image density uniformity in a late stage of allowing at high temperature and high humidity | Dot reproducibility in a late stage of allowing at high temperature and high humidity |
|---|---|---|---|---|---|---|---|---|---|---|---|
| Example | | | | | | | | | | | |
| 1 | 1 | A | 5.25 | 0.2 | 20.5 | 1.39 | 1.45 | 1.45 | 2.3 | 0.05 | 1 |
| 2 | 2 | B | 5.77 | 0.3 | 14.0 | 1.40 | 1.46 | 1.45 | 1.5 | 0.02 | 1 |
| 3 | 3 | C | 5.88 | 0.3 | 13.9 | 1.35 | 1.40 | 1.42 | 2.2 | 0.05 | 2 |
| 4 | 4 | D | 5.91 | 0.4 | 13.8 | 1.34 | 1.39 | 1.41 | 1.9 | 0.06 | 2 |
| 5 | 5 | E | 6.03 | 0.1 | 14.3 | 1.39 | 1.43 | 1.43 | 1.9 | 0.03 | 1 |
| 6 | 6 | F | 6.00 | 0.2 | 16.0 | 1.40 | 1.42 | 1.42 | 2.1 | 0.03 | 1 |
| 7 | 7 | G | 5.33 | 0.2 | 17.9 | 1.25 | 1.36 | 1.44 | 3.1 | 0.08 | 3 |
| Comp. Example | | | | | | | | | | | |
| 1 | 8 | a | 5.81 | 0.3 | 17.6 | 0.85 | 1.02 | 1.25 | 5.4 | 0.25 | 4 |

TABLE 2-continued

| | Magnetic toner No. | Magnetic iron oxide | Weight average diameter of magnetic toner (m) | Content of magnetic toner particles having diameter of 12.7 μm or more (% by volume) | Content of magnetic toner particles having diameter of less than 4.0 μm (% by number) | Image density: I the morning after allowing at high temperature and high humidity | Image density: In a late stage of allowing at high temperature and high humidity | Image density: In a late stage of allowing at low temperature and low humidity | Fogging (both sides) in a late stage of allowing at low temperature and low humidity | Image density uniformity in a late stage of allowing at high temperature and high humidity | Dot reproducibility in a late stage of allowing at high temperature and high humidity |
|---|---|---|---|---|---|---|---|---|---|---|---|
| 2 | 9 | b | 5.30 | 0.2 | 16.3 | 0.72 | 1.00 | 1.30 | 6.2 | 0.31 | 4 |
| 3 | 10 | c | 6.61 | 0.4 | 13.1 | 0.75 | 1.01 | 1.33 | 6.0 | 0.33 | 4 |
| 4 | 11 | d | 5.73 | 0.1 | 12.3 | 1.00 | 1.03 | 1.23 | 6.1 | 0.28 | 4 |
| 5 | 12 | e | 5.86 | 0.3 | 17.7 | 0.71 | 0.93 | 1.30 | 5.1 | 0.37 | 4 |
| 6 | 13 | f | 5.54 | 0.1 | 16.0 | 1.04 | 1.03 | 1.22 | 6.7 | 0.31 | 4 |
| 7 | 14 | g | 5.96 | 0.1 | 13.1 | 0.83 | 1.00 | 1.23 | 5.0 | 0.29 | 4 |
| 8 | 15 | h | 6.66 | 0.1 | 12.1 | 0.88 | 1.03 | 1.27 | 5.3 | 0.24 | 4 |
| 9 | 16 | i | 5.84 | 0.3 | 13.4 | 0.81 | 0.98 | 1.31 | 5.0 | 0.28 | 4 |
| 10 | 17 | j | 6.07 | 0.1 | 11.8 | 0.99 | 1.04 | 1.33 | 6.8 | 0.36 | 4 |

Production of Magnetic Iron Oxide II

Production Example 8

To an aqueous ferrous sulfate solution was added sodium silicate so that the silicon element content was 1.5% based on the iron element, and zinc sulfate was further added so that the zinc element content was 0.5% based on the iron element. Then sodium hydroxide solution was mixed in an amount of 1.0 to 1.1 equivalents based on iron ions to prepare an aqueous solution containing ferrous hydroxide.

Air was blown into the aqueous solution at the pH maintained at 7 to 10 (for example pH 9), followed by oxidation reaction at 80 to 90° C. to prepare a slurry solution for generating seed crystals.

Then, to this slurry solution was added an aqueous ferrous sulfate solution so that the content was 0.9 to 1.2 equivalents to the initial alkali amount (the sodium component and sodium silicate and the sodium component of sodium hydroxide). Air was blown into the slurry solution to progress oxidation reaction at the pH maintained at 6 to 10 (for example pH 8), and the pH was adjusted in the final state of the oxidation reaction to localize silicate component and zinc component in the surfaces of the magnetic iron oxide particles. The thus-produced magnetic iron oxide particles were washed, filtered off, and dried by a normal method, and then agglomerates were cracked to obtain magnetic iron oxide AA.

For the thus-obtained magnetic iron oxide AA, the relations between the iron element and the solubilities of the silicon element and other metal elements, and characteristics thereof are shown in Table 3.

Production Examples 9 to 13

Magnetic iron oxides BB to FF having the characteristics shown in Table 3 were obtained by the same method as Production Example 8 except that the amount of sodium silicate and the amounts of other metal salts added were changed as shown in Table 3.

Comparative Production Example 11

Magnetic iron oxide aa having the characteristics shown in Table 3 was obtained by the same method as Production Example 8 except that neither sodium silicate nor zinc sulfate were added.

Comparative Production Example 12

0.7 part by weight of silicate fine powder was mixed with 100 parts by weight of magnetic iron oxide obtained by Comparative Production Example 11 by using a Henschel mixer to obtain magnetic iron oxide bb having the characteristics shown in Table 3.

Comparative Production Example 13

Magnetic iron oxides cc to gg having the characteristics shown in Table 3 were obtained by the same method as Production Example 8 except that the amount of sodium silicate and the amounts of other metal salts added were changed as shown in Table 3.

TABLE 3

| Production Example No. | Magnetic iron oxide | Silicon element content (%) | $(B_{Si}/A_{Si}) \times 100$ (%) | $(C_{Si}/A_{Si}) \times 100$ (%) | Manganese element content (%) | $(B_{Mn}/A_{Mn}) \times 100$ (%) | Zinc element content (%) | $(B_{Zn}/A_{Zn}) \times 100$ (%) | Copper element content (%) | $(B_{Cu}/A_{Cu}) \times 100$ (%) | Nickerl element content (%) | $(B_{Ni}/A_{Ni}) \times 100$ (%) | Bulk density (g/cm) | Spheroidicity φ |
|---|---|---|---|---|---|---|---|---|---|---|---|---|---|---|
| Example | | | | | | | | | | | | | | |
| 8 | AA | 0.5 | 56 | 48 | — | — | 0.5 | 84 | — | — | — | — | 0.57 | 0.91 |
| 9 | BB | 0.6 | 72 | 53 | 1.2 | 74 | 0.6 | 83 | — | — | — | — | 0.56 | 0.92 |
| 10 | CC | 0.7 | 63 | 51 | — | — | 0.5 | 80 | 0.5 | 98 | — | — | 0.56 | 0.85 |
| 11 | DD | 0.5 | 70 | 55 | 1.1 | 75 | 0.6 | 66 | 0.5 | 98 | — | — | 0.57 | 0.91 |
| 12 | EE | 0.7 | 66 | 56 | — | — | — | — | — | — | 0.4 | 65 | 0.59 | 0.84 |

TABLE 3-continued

| Production Example No. | Magnetic iron oxide | Silicon element content (%) | $(B_{Si}/A_{Si}) \times 100$ (%) | $(C_{Si}/A_{Si}) \times 100$ (%) | Manganese element content (%) | $(B_{Mn}/A_{Mn}) \times 100$ (%) | Zinc element content (%) | $(B_{Zn}/A_{Zn}) \times 100$ (%) | Copper element content (%) | $(B_{Cu}/A_{Cu}) \times 100$ (%) | Nickerl element content (%) | $(B_{Ni}/A_{Ni}) \times 100$ (%) | Bulk density (g/cm) | Spheroidicity φ |
|---|---|---|---|---|---|---|---|---|---|---|---|---|---|---|
| 13 | FF | 0.5 | 59 | 43 | 1.3 | 70 | — | — | — | — | 0.4 | 91 | 0.58 | 0.89 |
| Comp. Example | | | | | | | | | | | | | | |
| 11 | aa | — | — | — | — | — | — | — | — | — | — | — | 0.63 | 0.82 |
| 12 | bb | * | 100 | 100 | — | — | — | — | — | — | — | — | 0.68 | 0.84 |
| 13 | cc | 0.7 | 77 | 66 | — | — | — | — | — | — | — | — | 0.51 | 0.90 |
| 14 | dd | — | — | — | 1.9 | 72 | — | — | — | — | — | — | 0.54 | 0.87 |
| 15 | ee | 1.2 | 78 | 66 | — | — | — | — | 1.2 | 84 | — | — | 0.62 | 0.92 |
| 16 | ff | 0.1 | 47 | 37 | 0.4 | 74 | — | — | — | — | — | — | 0.60 | 0.86 |
| 17 | gg | 0.4 | 31 | 20 | — | — | — | — | 0.07 | 92 | — | — | 0.60 | 0.92 |

* 0.7% Henschel mixing

Production of Toner II

Example 8

Styrene-n-butyl acrylate copolymer (copolymerization weight ratio=70:30, Mw=280,000, Tg=59° C.) 100 parts Magnetic iron oxide AA of Production Example 8 95 parts Negative charge controlling agent represented by the following formula: 2 parts

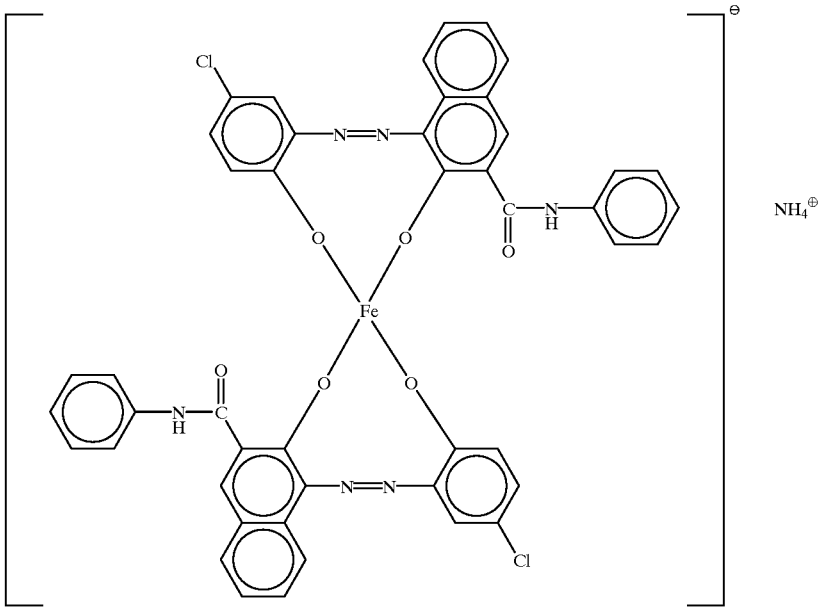

Acrylic acid-modified propylene-ethylene copolymer wax (acid value 11.0 mgKOH/g, DSC endothermic peak at 128° C., ethylene content 6% by weight) 3 parts A mixture of the above components was melted and kneaded by a biaxial extruder heated to 140° C., and then cooled. The kneaded mixture was coarsely ground by a hammer mill, and then finely ground by a jet mill to obtain a finely-ground powder. The finely-ground powder was classified by a fixed wall type pneumatic classifier to produce classified powder. The thus-obtained classified powder was strictly classified by a multi-division classifier (Produced by Nitesu Kogyo Co., Erbojet Classifier) employing a Coanda effect to remove ultrafine powder and coarse powder, to obtain negative chargeable magnetic toner particles having a weight average particle diameter ($D^4$) of 6.8 μm, and a volume average particle diameter ($D_1$) of 5.37 μm, and containing 0.1% of magnetic toner particles having a particle diameter of 12.7 μm or more and 19.7% of magnetic toner particles having a particle diameter of less than 4.0 μm.

100 parts of the magnetic toner particles, 1.2 parts of hydrophobic silica fine powder (BET 300 $m^2/g$) which was treated with dimethyldichlorosilane, hexamethyldisilane and then dimethyl silicone oil, and 0.08 part of styrene-acrylic fine particles (average particle diameter 0.05 μm) obtained by soap free polymerization were mixed by a Henschel mixer to prepare negative chargeable magnetic toner 18.

Print Out Test

A laser beam printer Laser shot 430 produced by Canon Inc. (8 sheets/min) was used for evaluating the state of supply of the toner to the sleeve and the images formed. The image forming apparatus shown in FIG. 1 and the process cartridge shown in FIG. 2 were used for the print out test by the following method. This print out test was carried out as an extreme simulation in which the toner in the process cartridge was deviated to one side and tapped when the process cartridge was transported for a long time.

The process cartridge was filled with 100 g of toner.

The process cartridge was set in a standing condition so that the development sleeve in the cartridge was perpendicular to the ground surface, and normally dropped 10 times onto a base covered with a buffer such as a cloth or the like from a height of about 10 cm.

After the tenth dropping of the process cartridge, the process cartridge in a standing condition was allowed to stand for 2 days in the environment of the print out test.

Primary charge was set to −650 V, and the space between the photosensitive drum and the magnetic toner layer on the development sleeve (containing the magnet) was set to be non-contact. An AD bias (f=1800 Hz, Vpp=1200 V) and a DC bias ($V_{DC}$=−400 V) were applied to the development sleeve to develop an electrostatic latent image with $V_L$ (the potential of the electrostatic latent image portion) of −130 V, to form a magnetic toner image on the OPC photosensitive member.

The magnetic toner image formed on the OPC photosensitive member was transferred to plain paper at the above-described plus transfer potential, and the plain paper having the magnetic toner image was passed through the fixing unit comprising heating and pressure rollers to fix the magnetic toner image.

At this time, the surface temperature of the heating roller of the heating pressure roller fixing unit was set to 180° C., and the total pressure between the heating roller and the pressure roller was set to 7.5 kg.

Under the above set conditions, the print out test was continuously carried out for 30,000 sheets by using the process cartridge allowed to stand for 2 days in an environment of high temperature and high humidity (32.5° C., 85% RH), and an environment of low temperature and low humidity (15° C., 10% RH), and the obtained images were evaluated with respect to the items such as (1) the image density, (2) uniformity of image density in page (3) fogging and (4) image quality by the same method as Example 1.

The results of evaluation are shown in Table 5.

Examples 9 to 12

Magnetic toners 19 to 22 of Examples 9 to 12 were obtained by the same method as Example 8 except that magnetic iron oxides BB to EE of Production Examples 9 to 12 and the wax shown in Table 4 were respectively used. The magnetic toners 19 to 22 obtained were evaluated by the same method as Example 8. The results of evaluation are shown in Table 5.

Example 13

Negative chargeable magnetic toner 23 was obtained by the same method as Example 8 except that magnetic iron oxide FF of Production Examples 13 and the wax shown in Table 4 were used, and 4 parts of unmodified polypropylene wax (propylene component 99% or more, DSC endothermic peak at 137° C.) was further added. The magnetic toner 23 obtained was evaluated by the same method as Example 8. The results of evaluation are shown in Table 5.

Example 14

Negative chargeable magnetic toner 24 of Example 14 was obtained by the same method as Example 8 except that the wax shown in Table 4 were used. The magnetic toner 24 obtained was evaluated by the same method as Example 8. The results of evaluation are shown in Table 5.

Comparative Examples 11 to 17

Magnetic toners 25 to 31 were produced by the same method as Example 8 except that magnetic iron oxides aa to gg of Comparative Production Examples 11 to 17, and the wax shown in Table 4 were respectively used. The results of evaluation are shown in Table 5.

TABLE 4

| | Wax | Wax acid value (mgKOH/g) | DSC endothermic peak (C) | Ethylene component content (%) | Amount of wax used (parts) |
|---|---|---|---|---|---|
| Example 8 | Acrylic acid modified PP-PE | 11.0 | 128 | 6 | 3 |
| 9 | Maleic anhydride modified PP-PE | 2.1 | 128 | 5 | 3 |
| 10 | Maleic anhydride modified PP-PE | 4.3 | 125 | 11 | 3 |
| 11 | Maleic anhydride modified PP-PE | 3.7 | 128 | 6 | 3 |
| 12 | Maleic anhydride modified PP-PE | 4.3 | 125 | 11 | 3 |
| 13 | Maleic anhydride modified PP-PE | 3.7 | 128 | 6 | 3 |
| | polypropylene wax | 0 | 137 | 1 or less | 4 |
| 14 | Polypropylene wax | 0 | 137 | 1 or less | 3 |
| Comp. Example 11 | Maleic anhydride modified PP-PE | 0.8 | 127 | 6 | 3 |
| 12 | Acrylic acid modified PP-PE | 31.3 | 128 | 5 | 3 |
| 13 | Maleic anhydride modified PP-PE | 0.5 | 135 | 2 | 3 |
| 14 | Acrylic acid modified PP-PE | 31.3 | 128 | 5 | 3 |
| 15 | Maleic anhydride modified PP-PE | 1.5 | 135 | 2 | 3 |

TABLE 4-continued

| | Wax | Wax acid value (mgKOH/g) | DSC endothermic peak (C) | Ethylene component content (%) | Amount of wax used (parts) |
|---|---|---|---|---|---|
| 16 | Acrylic acid modified PP-PE | 0.8 | 127 | 6 | 3 |
| 17 | Acrylic acid modified PP-PE | 31.3 | 128 | 5 | 3 |

TABLE 5

| | Magnetic toner No. | Magnetic iron oxide | Weight average diameter of magnetic toner (m) | Content of magnetic toner particles having diameter of 12.7 μm or more (% by volume) | Content of magnetic toner particles having diameter of less than 4.0 μm (% by number) | Image density: High temperature and high humidity | Image density: Low temperature and low humidity | Fogging (both sides) at low temperature and low humidity | Image density uniformity at high temperature and high humidity | Dot reproducibility at high temperature and high humidity |
|---|---|---|---|---|---|---|---|---|---|---|
| Example | | | | | | | | | | |
| 8 | 18 | AA | 5.37 | 0.1 | 19.7 | 1.35 | 1.41 | 2.1 | 0.04 | 2 |
| 9 | 19 | BB | 5.83 | 0.1 | 14.3 | 1.41 | 1.45 | 1.6 | 0.03 | 1 |
| 10 | 20 | CC | 5.67 | 0.2 | 15.3 | 1.37 | 1.44 | 2.0 | 0.03 | 1 |
| 11 | 21 | DD | 5.51 | 0.3 | 18.2 | 1.42 | 1.46 | 1.3 | 0.01 | 1 |
| 12 | 22 | EE | 6.03 | 0.1 | 11.1 | 1.34 | 1.38 | 2.1 | 0.05 | 1 |
| 13 | 23 | FF | 6.12 | 0.1 | 10.2 | 1.40 | 1.46 | 2.3 | 0.02 | 2 |
| 14 | 24 | AA | 5.93 | 0.2 | 13.7 | 1.41 | 1.37 | 2.5 | 0.03 | 2 |
| Comp. Example | | | | | | | | | | |
| 11 | 25 | aa | 6.61 | 0.1 | 12.0 | 0.91 | 1.33 | 4.8 | 0.31 | 3 |
| 12 | 26 | bb | 5.31 | 0.3 | 18.8 | 0.80 | 1.29 | 6.0 | 0.26 | 4 |
| 13 | 27 | cc | 5.29 | 0.1 | 19.9 | 0.78 | 1.23 | 5.1 | 0.38 | 3 |
| 14 | 28 | dd | 6.60 | 0.1 | 10.3 | 0.85 | 1.27 | 5.5 | 0.32 | 3 |
| 15 | 29 | ee | 6.53 | 0.1 | 11.1 | 0.75 | 1.21 | 5.9 | 0.40 | 3 |
| 16 | 30 | ff | 5.29 | 0.3 | 18.9 | 0.92 | 1.31 | 6.1 | 0.30 | 4 |
| 17 | 31 | gg | 6.67 | 0.1 | 10.0 | 0.86 | 1.26 | 6.4 | 0.29 | 4 |

What is claimed is:

1. A magnetic toner comprising:

magnetic toner particles containing at least a binder resin and magnetic iron oxide;

wherein the magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element based on an iron element; the ratio $(B_{si}/A_{Si})\times100$ of the content $B_{Si}$ of the silicon element present in the magnetic iron oxide up to an iron element solubility of 20% by weight to the total content $A_{Si}$ of the silicon element present in the magnetic iron oxide is 45 to 85%; the ratio $(C_{si}/A_{si})\times100$ of the content $C_{Si}$ of the silicon element present in the magnetic iron oxide up to an iron element solubility of 10% by weight to the total content $A_{Si}$ is 35 to 70%; and the magnetic toner has a weight average particle diameter of 3.5 to 10.0 μm, and contains 0 to 30% by volume of magnetic toner particles having a volume particle diameter of 12.7 μm or more determined from a volume distribution.

2. The magnetic toner according to claim 1, wherein in the magnetic iron oxide, the ratio $(B_{Metal}/A_{Metal})\times100$ of the content $B_{Metal}$ of at least one metal element selected from the group consisting of Mn, Zn, Ni, Cu, Co, Cr, Cd, Al, Sn and Mg and present in the magnetic iron oxide up to an iron element solubility of 20% by weight to the content $A_{metal}$ of the metal group element present in the magnetic iron oxide is 40 to 100%.

3. The magnetic toner according to claim 1, wherein the magnetic iron oxide contains 0.7 to 2.0% by weight of Mn based on the iron element, and the ratio $(B_{Mn}/A_{Mn})\times100$ of the content $B_{Mn}$ of Mn element present in the magnetic iron oxide up to an iron element solubility of 20% by weight to the total content $A_{Mn}$ of Mn element present in the magnetic iron oxide is 50 to 90%.

4. The magnetic toner according to claim 1, wherein the magnetic iron oxide contains 0.2 to 0.8% by weight of Zn based on the iron element, and the ratio $(B_{Zn}/A_{Zn})\times100$ of the content $B_{Zn}$ of Zn element present in the magnetic iron oxide up to an iron element solubility of 20% by weight to the total content $A_{Zn}$ of Zn element present in the magnetic iron oxide is 40 to 100%.

5. The magnetic toner according to claim 1, wherein the magnetic iron oxide contains 0.01 to 0.8% by weight of Cu based on the iron element, and the ratio $(B_{Cu}/A_{Cu})\times100$ of the content $B_{Cu}$ of Cu element present in the magnetic iron oxide up to an iron element solubility of 10% by weight to the total content $A_{Cu}$ of Cu element present in the magnetic iron oxide is 70 to 100%.

6. The magnetic toner according to claim 1, wherein the magnetic iron oxide contains 0.1 to 0.6% by weight of Ni based on the iron element, and the ratio $(B_{Ni}/A_{Ni})\times100$ of the content $B_{Ni}$ of Ni element present in the magnetic iron oxide up to an iron element solubility of 20% by weight to the total content $A_{Ni}$ of Ni element present in the magnetic iron oxide is 40 to 100%.

7. The magnetic toner according to claim 1, wherein the magnetic iron oxide has a bulk density of 0.4 to 0.8 g/cm$^3$.

8. The magnetic toner according to claim 1, wherein the magnetic iron oxide has a bulk density of 0.5 to 0.7 g/cm$^3$.

9. The magnetic toner according to claim 1, wherein the magnetic iron oxide has spheroidicity of 0.80 or more.

10. The magnetic toner according to claim 1, wherein the magnetic iron oxide has spheroidicity of 0.80 to 1.00.

11. The magnetic toner according to claim 1, wherein the magnetic iron oxide has a number average particle diameter of 0.05 to 1.00 $\mu$m.

12. The magnetic toner according to claim 1, wherein the magnetic iron oxide has a number average particle diameter of 0.10 to 0.40 $\mu$m.

13. The magnetic toner according to claim 1, wherein the magnetic toner has a volume average particle diameter of 2.5 to 6.0 $\mu$m.

14. The magnetic toner according to claim 1, wherein the magnetic toner particles contain 20 to 200 parts by weight of the magnetic iron oxide based on 100 parts by weight of the binder resin.

15. The magnetic toner according to claim 1, wherein the magnetic toner particles contain 30 to 150 parts by weight of the magnetic Iron oxide based on 100 parts by weight of the binder resin.

16. The magnetic toner according to claim 1, wherein the magnetic toner particles further contain hydrocarbon wax, ethylenic olefin polymer or ethylenic olefin copolymer.

17. The magnetic toner according to claim 1, wherein the magnetic toner particles further contain polypropylene wax having a acid value of 1 to 30 mgKOH/g.

18. The magnetic toner according to claim 1, wherein the magnetic toner particles further contain polypropylene wax having a acid value of 1 to 15 mgKOH/g.

19. The magnetic toner according to claim 17, wherein the wax has an endothermic peak at 130° C. or less in differential scanning calorimetry (DSC).

20. The magnetic toner according to claim 17, wherein the wax contains 3% by weight or more of ethylene component.

21. The magnetic toner according to claim 17, wherein the wax contains 3 to 20% by weight of ethylene component.

22. The magnetic toner according to claim 17, wherein the wax contains 3 to 10% by weight of ethylene component.

23. The magnetic toner according to claim 17, wherein the wax is modified with at least one acid monomer selected from maleic acid, maleic acid half ester, and maleic anhydride.

24. The magnetic toner according to claim 1, comprising a mixture of the magnetic toner particles and an inorganic fine powder.

25. The magnetic toner according to claim 24, wherein the inorganic fine powder is subjected to hydrophobic treatment.

26. The magnetic toner according to claim 24, wherein the inorganic fine powder comprises a silica fine powder or titanium fine powder.

27. The magnetic toner according to claim 26, wherein the silica fine powder is treated with a silane coupling agent and silicone oil.

28. The magnetic toner according to claim 27, wherein the silica fine powder is treated with a silane coupling agent and then silicone oil, or simultaneously treated with a silane coupling agent and silicone oil.

29. The magnetic toner according to claim 24, wherein the content of the inorganic fine powder is 0.1 to 5.0 parts by weight based on 100 parts by weight of the magnetic toner particles.

30. The magnetic toner according to claim 1, comprising a mixture of the magnetic toner, the inorganic fine powder and resin fine particles.

31. An image forming method comprising the steps of:

charging an electrostatic latent image holding member for holding an electrostatic latent image;

forming an electrostatic latent image on the charged electrostatic latent image holding member; and developing the electrostatic latent image on the electrostatic latent image holding member by a magnetic toner to form a toner image;

wherein the magnetic toner comprises magnetic toner particles containing at least a binder resin and magnetic iron oxide;

the magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element on the basis of an iron element;

the ratio $(B_{si}/A_{Si})\times100$ of the content $B_{Si}$ of the silicon element present in the magnetic iron oxide up to an iron element solubility of 20% by weight to the total content $A_{Si}$ of the silicon element present in the magnetic iron oxide is 45 to 85%;

the ratio $(C_{si}/A_{Si})\times100$ of the content $C_{Si}$ of the silicon element present in the magnetic iron oxide up to an iron element solubility of 10% by weight to the total content $A_{Si}$ is 35 to 70%; and the magnetic toner has a weight average particle diameter of 3.5 to 10.0 $\mu$m, and contains 0 to 30% by volume of magnetic toner particles having a volume particle diameter of 12.7 $\mu$m or more determined from a volume distribution.

32. The method according to claim 31, wherein in the magnetic iron oxide, the ratio $(B_{Metal}/A_{Metal})\times100$ of the content $B_{Metal}$ of at least one metal element selected from the group consisting of Mn, Zn, Ni, Cu, Co, Cr, Cd, Al, Sn and Mg and present in the magnetic iron oxide up to an iron element solubility of 20% by weight to the content $A_{metal}$ of the metal group element present in the magnetic iron oxide is 40 to 100%.

33. The method according to claim 31, wherein the magnetic iron oxide contains 0.7 to 2.0% by weight of Mn based on the iron element, and the ratio $(B_{Mn}/A_{Mn})\times100$ of the content $B_{Mn}$ of Mn element present in the magnetic iron oxide up to an iron element solubility of 20% by weight to the total content $A_{Mn}$ of Mn element present in the magnetic iron oxide is 50 to 90%.

34. The method according to claim 31, wherein the magnetic iron oxide contains 0.2 to 0.8% by weight of Zn based on the iron element, and the ratio $(B_{Zn}/A_{Zn})\times100$ of the content $B_{Zn}$ of Zn element present in the magnetic iron oxide up to an iron element solubility of 20% by weight to the total content $A_{Zn}$ of Zn element present in the magnetic iron oxide is 40 to 100%.

35. The method according to claim 31, wherein the magnetic iron oxide contains 0.01 to 0.8% by weight of Cu based on the iron element, and the ratio $(B_{Cu}/A_{Cu})\times100$ of the content $B_{Cu}$ of Cu element present in the magnetic iron oxide up to an iron element solubility of 10% by weight to the total content $A_{Cu}$ of Cu element present in the magnetic iron oxide is 70 to 100%.

36. The method according to claim 31, wherein the magnetic iron oxide contains 0.1 to 0.6% by weight of Ni based on the iron element, and the ratio $(B_{Ni}/A_{Ni})\times100$ of the content $B_{Ni}$ of Ni element present in the magnetic iron oxide up to an iron element solubility of 20% by weight to the total content $A_{Ni}$ of Ni element present in the magnetic iron oxide is 40 to 100%.

37. The method according to claim 31, wherein the magnetic iron oxide has a bulk density of 0.4 to 0.8 g/cm$^3$.

38. The method according to claim 31, wherein the magnetic iron oxide has a bulk density of 0.5 to 0.7 g/cm$^3$.

39. The method according to claim 31, wherein the magnetic iron oxide has spheroidicity of 0.80 or more.

40. The method according to claim 31, wherein the magnetic iron oxide has spheroidicity of 0.80 to 1.00.

41. The method according to claim 31, wherein the magnetic iron oxide has a number average particle diameter of 0.05 to 1.00 $\mu$m.

42. The method according to claim 31, wherein the magnetic iron oxide has a number average particle diameter of 0.10 to 0.40 $\mu$m.

43. The method according to claim 31, wherein the magnetic toner has a volume average particle diameter of 2.5 to 6.0 $\mu$m.

44. The method according to claim 31, wherein the magnetic toner particles contain 20 to 200 parts by weight of the magnetic iron oxide based on 100 parts by weight of the binder resin.

45. The method according to claim 31, wherein the magnetic toner particles contain 30 to 150 parts by weight of the magnetic iron oxide based on 100 parts by weight of the binder resin.

46. The method according to claim 31, wherein the magnetic toner particles further contain hydrocarbon wax, ethylenic olefin polymer or ethylenic olefin copolymer.

47. The method according to claim 31, wherein the magnetic toner particles further contain polypropylene wax having an acid value of 1 to 30 mgKOH/g.

48. The method according to claim 31, wherein the magnetic toner particles further contain polypropylene wax having an acid value of 1 to 15 mgKOH/g.

49. The method according to claim 47, wherein the wax has an endothermic peak at 130° C. or less in differential scanning calorimetry (DSC).

50. The method according to claim 47, wherein the wax contains 3% by weight or more of ethylene component.

51. The method according to claim 47, wherein the wax contains 3 to 20% by weight of ethylene component.

52. The method according to claim 47, wherein the wax contains 3 to 10% by weight of ethylene component.

53. The method according to claim 47, wherein the wax is modified with at least one acid monomer selected from maleic acid, maleic acid half ester, and maleic anhydride.

54. The method according to claim 31, comprising a mixture of the magnetic toner particles and an inorganic fine powder.

55. The method according to claim 54, wherein the inorganic fine powder is subjected to hydrophobic treatment.

56. The method according to claim 54, wherein the inorganic fine powder comprises a silica fine powder or titanium fine powder.

57. The method according to claim 56, wherein the silica fine powder is treated with a silane coupling agent and silicone oil.

58. The method according to claim 57, wherein the silica fine powder is treated with a silane coupling agent and then silicone oil, or simultaneously treated with a silane coupling agent and silicone oil.

59. The method according to claim 54, wherein the content of the inorganic fine powder is 0.1 to 5.0 parts by weight based on 100 parts by weight of the magnetic toner particles.

60. The method according to claim 31, comprising a mixture of the magnetic toner, the inorganic fine powder and resin fine particles.

61. The method according to claim 31, wherein the electrostatic latent image holding member comprises an electrophotographic photosensitive member.

62. The method according to claim 31, wherein the toner image formed on the electrostatic latent image holding member is transferred to a transfer material.

63. The method according to claim 62, wherein the toner image transferred to the transfer material is fixed under heating.

64. The method according to claim 62, wherein after transfer, the surface of the electrostatic latent image holding member is cleaned.

65. The method according to claim 31, wherein the magnetic toner is carried on the surface of a toner carrying member provided with a space from the electrostatic latent image holding member to form, on the surface of the toner carrying member, a toner layer thinner than the space between the electrostatic latent image holding member and the toner carrying member so that the electrostatic latent image formed on the electrostatic latent image holding member is developed by the magnetic toner of the toner layer formed on the surface of the toner carrying member in a development region where the electrostatic latent image holding member is opposite to the toner carrying member.

66. The method according to claim 65, wherein an AC bias or pulse bias is applied to the toner carrying member in development of the electrostatic latent image.

67. A process cartridge detachably mountable on a main assembly of an image forming apparatus comprising:

an electrostatic latent image holding member for holding an electrostatic latent image; and development means comprising a magnetic toner for developing the electrostatic latent image;

wherein the magnetic toner comprises magnetic toner particles containing at least a binder resin and magnetic iron oxide;

the magnetic iron oxide contains 0.2 to 4.0% by weight of at least one metal element selected from the group consisting of Mn, Zn, Ni, Cu, Co, Cr, Cd, Al, Sn and Mg, and 0.2 to 0.8% by weight of silicon element on the basis of an iron element;

the ratio $(B_{si}/A_{Si})\times100$ of the content $B_{Si}$ of the silicon element present in the magnetic iron oxide up to an iron element solubility of 20% by weight to the total content $A_{Si}$ of the silicon element present in the magnetic iron oxide is 45 to 85%;

the ratio $(C_{si}/A_{Si})\times100$ of the content $C_{Si}$ of silicon element present in the magnetic iron oxide up to an iron element solubility of 10% by weight to the total content $A_{Si}$ is 35 to 70%; and the magnetic toner has a weight average particle diameter of 3.5 to 10.0 $\mu$m, and contains 0 to 30% by volume of magnetic toner particles having a volume particle diameter of 12.7 $\mu$m or more determined from a volume distribution.

68. The process cartridge according to claim 67, wherein in the magnetic iron oxide, the ratio $(B_{Metal}/A_{Metal})\times100$ of the content $B_{Metal}$ of at least one metal element selected from the group consisting of Mn, Zn, Ni, Cu, Co, Cr, Cd, Al, Sn and Mg and present in the magnetic iron oxide up to an iron element solubility of 20% by weight to the content $A_{metal}$ of the metal group element present in the magnetic iron oxide is 40 to 100%.

69. The process cartridge according to claim 67, wherein the magnetic iron oxide contains 0.7 to 2.0% by weight of Mn based on the iron element, and the ratio $(B_{Mn}/A_{Mn})\times100$ of the content $B_{Mn}$ of Mn element present in the magnetic iron oxide up to an iron element solubility of 20% by weight to the total content $A_{Mn}$ of Mn element present in the magnetic iron oxide is 50 to 90%.

70. The process cartridge according to claim 67, wherein the magnetic iron oxide contains 0.2 to 0.8% by weight of Zn based on the iron element, and the ratio $(B_{Zn}/A_{Zn})\times100$ of the content $B_{Zn}$ of Zn element present in the magnetic iron oxide up to an iron element solubility of 20% by weight to the total content $A_{Zn}$ of Zn element present in the magnetic iron oxide is 40 to 100%.

71. The process cartridge according to claim 67, wherein the magnetic iron oxide contains 0.01 to 0.8% by weight of Cu based on the iron element, and the ratio $(B_{Cu}/A_{Cu})\times100$ of the content $B_{Cu}$ of Cu element present in the magnetic iron oxide up to an iron element solubility of 10% by weight to the total content $A_{Cu}$ of Cu element present in the magnetic iron oxide is 70 to 100%.

72. The process cartridge according to claim 67, wherein the magnetic iron oxide contains 0.1 to 0.6% by weight of Ni based on the iron element, and the ratio $(B_{Ni}/A_{Ni})\times100$ of the content $B_{Ni}$ of Ni element present in the magnetic iron oxide up to an iron element solubility of 20% by weight to the total content $A_{Ni}$ of Ni element present in the magnetic iron oxide is 40 to 100%.

73. The process cartridge according to claim 67, wherein the magnetic iron oxide has a bulk density of 0.4 to 0.8 $g/cm^3$.

74. The process cartridge according to claim 67, wherein the magnetic iron oxide has a bulk density of 0.5 to 0.7 $g/cm^3$.

75. The process cartridge according to claim 67, wherein the magnetic iron oxide has spheroidicity of 0.80 or more.

76. The process cartridge according to claim 67, wherein the magnetic iron oxide has spheroidicity of 0.80 to 1.00.

77. The process cartridge according to claim 67, wherein the magnetic iron oxide has a number average particle diameter of 0.05 to 1.00 $\mu$m.

78. The process cartridge according to claim 67, wherein the magnetic iron oxide has a number average particle diameter of 0.10 to 0.40 $\mu$m.

79. The process cartridge according to claim 67, wherein the magnetic toner has a volume average particle diameter of 2.5 to 6.0 $\mu$m.

80. The process cartridge according to claim 67, wherein the magnetic toner particles contain 20 to 200 parts by weight of the magnetic iron oxide based on 100 parts by weight of the binder resin.

81. The process cartridge according to claim 67, wherein the magnetic toner particles contain 30 to 150 parts by weight of the magnetic iron oxide based on 100 parts by weight of the binder resin.

82. The process cartridge according to claim 67, wherein the magnetic toner particles further contain hydrocarbon wax, ethylenic olefin polymer or ethylenic olefin copolymer.

83. The process cartridge according to claim 67, wherein the magnetic toner particles further contain polypropylene wax having an acid value of 1 to 30 mgKOH/g.

84. The process cartridge according to claim 67, wherein the magnetic toner particles further contain polypropylene wax having an acid value of 1 to 15 mgKOH/g.

85. The process cartridge according to claim 83, wherein the wax has an endothermic peak at 130° C. or less in differential scanning calorimetry (DSC).

86. The process cartridge according to claim 83, wherein the wax contains 3% by weight or more of ethylene component.

87. The process cartridge according to claim 83, wherein the wax contains 3 to 20% by weight of ethylene component.

88. The process cartridge according to claim 83, wherein the wax contains 3 to 10% by weight of ethylene component.

89. The process cartridge according to claim 83, wherein the wax is modified with at least one acid monomer selected from maleic acid, maleic acid half ester, and maleic anhydride.

90. The process cartridge according to claim 67, comprising a mixture of the magnetic toner particles and an inorganic fine powder.

91. The process cartridge according to claim 90, wherein the inorganic fine powder is subjected to hydrophobic treatment.

92. The process cartridge according to claim 90, wherein the inorganic fine powder comprises a silica fine powder or titanium fine powder.

93. The process cartridge according to claim 92, wherein the silica fine powder is treated with a silane coupling agent and silicone oil.

94. The process cartridge according to claim 93, wherein the silica fine powder is treated with a silane coupling agent and then silicone oil, or simultaneously treated with a silane coupling agent and silicone oil.

95. The process cartridge according to claim 90, wherein the content of the inorganic fine powder is 0.1 to 5.0 parts by weight based on 100 parts by weight of the magnetic toner particles.

96. The process cartridge according to claim 67, comprising a mixture of the magnetic toner, the inorganic fine powder and resin fine particles.

97. The process cartridge according to claim 67, wherein the electrostatic latent image holding member comprises an electrophotographic photosensitive member.

98. The process cartridge according to claim 67, wherein the development means comprises at least the magnetic toner, a toner container for containing the magnetic toner, and a toner carrying member for carrying the magnetic toner contained in the toner container and conveying the magnetic toner to the development region.

99. The process cartridge according to claim 98, wherein the development means further comprises a toner layer thickness regulating member for regulating the thickness of the toner layer formed on the surface of the toner carrying member by the magnetic toner.

100. The process cartridge according to claim 98, wherein the surfaces of the electrostatic latent image holding member and the toner carrying member are spaced, and the thickness of the toner layer formed on the surface of the toner carrying member is smaller than the space between the electrostatic latent image holding member and the toner carrying member.

101. The process cartridge according to claim 67, further comprising at least one member selected from the group consisting of a cleaning member for cleaning the surface of the electrostatic latent image holding member, and primary charging means for primarily charging the electrostatic latent image holding member.

* * * * *

UNITED STATES PATENT AND TRADEMARK OFFICE

CERTIFICATE OF CORRECTION

PATENT NO. : 6,007,957

DATED : December 28, 1999

INVENTOR(S) : TAKAKUNI KOBORI ET AL.

It is certified that error appears in the above-identified patent and that said Letters Patent is hereby corrected as shown below:

IN THE DRAWINGS:

Sheet 3 of 4, FIG. 3 "TRNSMITTING" should read --TRANSMITTING--.

COLUMN 3:

Line 21, "ion" should read --iron--;
Line 32, "fraction" should read --fractionation--; and
Line 52, "allowing" should read --being allowed--.

COLUMN 4:

Line 17, "tapped" should read --trapped--;
Line 40, "have" should read --has--;
Line 49, "In recent," should read --In recent years,--;
Line 50, "have" should read --has--; and
Line 67, "tribo" should read --triboelectric--.

COLUMN 7:

Line 37, "terms" should read --term--.

COLUMN 8:

Line 33, "stable" should read --unstable--; and
Line 60, "stable" should read --unstable--.

UNITED STATES PATENT AND TRADEMARK OFFICE

CERTIFICATE OF CORRECTION

PATENT NO. : 6,007,957

DATED : December 28, 1999

INVENTOR(S) : TAKAKUNI KOBORI ET AL.

It is certified that error appears in the above-identified patent and that said Letters Patent is hereby corrected as shown below:

COLUMN 10:

Line 9, "ion" should read --iron--;
Line 15, "ion" should read --iron--;
Line 38, "ouniformity" should read --uniformity--; and
Line 51, "2.0 m" should read --2.0 μm--.

COLUMN 11:

Line 47, "molt" should read --mol %--;
Line 48, "molt" should read --mol %--; and
Line 61, "ion" should read --iron--.

COLUMN 12:

Line 40, "olefin (particularly, ethylene s" should read --olefins (particularly, ethylene is--;
Line 42, "As an" should read --An--; and
Line 43, "include," should read --includes--.

COLUMN 13:

Line 50, "bromomethyldimethylchlorosialne," should read --bromomethyldimethychlorosilane,--; and
Line 56, "hexamethyldisiloxne," should read --hexamethyldisiloxane,--.

UNITED STATES PATENT AND TRADEMARK OFFICE

CERTIFICATE OF CORRECTION

PATENT NO. : 6,007,957

DATED : December 28, 1999

INVENTOR(S) : TAKAKUNI KOBORI ET AL.

It is certified that error appears in the above-identified patent and that said Letters Patent is hereby corrected as shown below:

COLUMN 14:

Line 47, "steary" should read --stearyl--.

COLUMN 15:

Line 8, "As" should read --As is--;
Line 37, "be" should read --been--; and
Line 66, "more" should read --greater than--.

COLUMN 16:

Line 41, "plate" should read --flat--.

COLUMN 18:

Line 52, "followed" should read --followed by--.

COLUMN 19:

Line 15, "pre-history" should read--heat transfer--; and
Line 65, "an" should read --a--.

COLUMN 20:

Line 29, "gain" should be deleted; and
Line 42, "tribo" should read --triboelectric--.

UNITED STATES PATENT AND TRADEMARK OFFICE

CERTIFICATE OF CORRECTION

PATENT NO. : 6,007,957

DATED : December 28, 1999

INVENTOR(S) : TAKAKUNI KOBORI ET AL.

It is certified that error appears in the above-identified patent and that said Letters Patent is hereby corrected as shown below:

COLUMN 24:

Table 1, "Nickerl" should read --Nickel--.

COLUMN 25:

Table 1, "Nickerl" should read --Nickel--.

COLUMN 28:

Line 1, "having" should read --had--; and
Table 2, "I the" should read --In the--.

COLUMN 29:

Table 2, "I the" should read --In the--; and
Line 42, "progress" should read --accelerate the--.

COLUMN 30:

Table 3, "Nickerl" should read --Nickel--.

COLUMN 32:

Table 3, "Nickerl" should read --Nickel--.

COLUMN 33:

Line 3, "tapped" should read --trapped--.

UNITED STATES PATENT AND TRADEMARK OFFICE

CERTIFICATE OF CORRECTION

PATENT NO. : 6,007,957

DATED : December 28, 1999

INVENTOR(S) : TAKAKUNI KOBORI ET AL.

It is certified that error appears in the above-identified patent and that said Letters Patent is hereby corrected as shown below:

COLUMN 34:

Line 29, "were" should read --was--.

Signed and Sealed this

Tenth Day of April, 2001

*Attest:*

Nicholas P. Godici

NICHOLAS P. GODICI

*Attesting Officer*

*Acting Director of the United States Patent and Trademark Office*